US011627422B2

(12) United States Patent
Meskens et al.

(10) Patent No.: US 11,627,422 B2
(45) **Date of Patent: *Apr. 11, 2023**

(54) LOW-POWER ACTIVE BONE CONDUCTION DEVICES

(71) Applicant: Cochlear Limited, Macquarie University (AU)

(72) Inventors: Werner Meskens, Opwijk (BE); Wim Bervoets, Wilrijk (BE); Carl Van Himbeeck, Zottegem (BE)

(73) Assignee: Cochlear Limited, Macquarie University (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/526,456

(22) Filed: Nov. 15, 2021

(65) Prior Publication Data

US 2022/0078563 A1 Mar. 10, 2022

Related U.S. Application Data

(63) Continuation of application No. 16/991,442, filed on Aug. 12, 2020, now Pat. No. 11,202,158, which is a continuation of application No. 16/679,729, filed on Nov. 11, 2019, now Pat. No. 10,798,503, which is a continuation of application No. 16/117,195, filed on Aug. 30, 2018, now Pat. No. 10,477,331, which is a continuation of application No. 15/700,373, filed on Sep. 11, 2017, now Pat. No. 10,097,934, which is a (Continued)

(51) Int. Cl.
*H04R 25/00* (2006.01)
*H04R 25/02* (2006.01)

(52) U.S. Cl.
CPC ..... *H04R 25/606* (2013.01); *H04R 25/02* (2013.01); *H04R 2460/13* (2013.01)

(58) Field of Classification Search
CPC ... H04R 25/606; H04R 25/02; H04R 2460/13
USPC ..... 381/326
See application file for complete search history.

(56) References Cited

U.S. PATENT DOCUMENTS 3,916,373 A 10/1975 Schroder
4,207,442 A 6/1980 Freeman
4,404,502 A 9/1983 Magori et al.

(Continued)

OTHER PUBLICATIONS

Adams, "Sigma-Delta New algorithms and Techniques," retrieved from https://www.cscamm.umd.edu/programs/ocq05/adams/adams_ocq05.pdf, on Jun. 27, 2014, 175 pages.

(Continued)

*Primary Examiner* — Sean H Nguyen
(74) *Attorney, Agent, or Firm* — Edell, Shapiro & Finnan, LLC

(57) ABSTRACT

Presented herein are low-power active bone conduction devices that comprise an actuator that is subcutaneously implanted within a recipient so as to deliver mechanical output forces to hard tissue of the recipient. The low-power active bone conduction devices include an energy recovery circuit configured to extract non-used energy from the actuator and to store the non-used energy for subsequent use by the actuator. The low-power active bone conduction devices may also include a multi-bit sigma-delta converter that operates in accordance with a scaled sigma-delta quantization threshold value to convert received signals representative of sound into actuator drive signals.

20 Claims, 19 Drawing Sheets

Related U.S. Application Data continuation of application No. 14/317,410, filed on Jun. 27, 2014, now Pat. No. 9,794,703.

(56) References Cited

U.S. PATENT DOCUMENTS

| | | | |
|---|---|---|---|
| 6,570,818 | B1 | 5/2003 | Kirjavainen |
| 7,058,463 | B1 | 6/2006 | Ruha et al. |
| 7,274,173 | B2 | 9/2007 | Inoshita et al. |
| 2002/0196955 | A1 | 12/2002 | Boesen et al. |
| 2004/0032962 | A1 | 2/2004 | Westerkull |
| 2006/0183965 | A1 | 8/2006 | Kasic et al. |
| 2007/0036375 | A1 | 2/2007 | Jensen |
| 2010/0034409 | A1 | 2/2010 | Fay et al. |
| 2010/0048982 | A1 | 2/2010 | Puria et al. |
| 2010/0208924 | A1 | 8/2010 | Westerkull |
| 2013/0028448 | A1 | 1/2013 | Choi et al. |
| 2021/0029476 | A1 | 1/2021 | Meskens et al. |

OTHER PUBLICATIONS

Campolo, et al., "Efficient Charge Recovery Method for Driving Piezoelectric Actuators with Quasi-Square Waves," IEEE Transactions on Ultrasonics, Ferroelectrics, and Frequency Control, vol. 60, No. 3, Mar. 2003, pp. 237-244.

Low ESR Capacitors, Aug. 30, 2011, Low-ESR.com, NIC Components Corp., pp. 1-2.

HALF H-BRIDGE (HB)

LOW-POWER ACTIVE BONE CONDUCTION DEVICES

CROSS-REFERENCE TO RELATED APPLICATION

This application is a continuation of U.S. patent application Ser. No. 16/991,442 filed Aug. 12, 2020, which is a continuation of U.S. patent application Ser. No. 16/679,729 filed Nov. 11, 2019, which is a continuation of U.S. patent application Ser. No. 16/117,195, filed Aug. 30, 2018, which is a continuation of U.S. patent application Ser. No. 15/700,373, filed on Sep. 11, 2017, which is a continuation of U.S. patent application Ser. No. 14/317,410, filed Jun. 27, 2014, the entire contents of which is incorporated herein by reference.

BACKGROUND

Field of the Invention

The present invention relates generally to active bone conduction devices.

Related Art

Hearing loss, which may be due to many different causes, is generally of two types, conductive and/or sensorineural. Conductive hearing loss occurs when the normal mechanical pathways of the outer and/or middle ear are impeded, for example, by damage to the ossicular chain or ear canal. Sensorineural hearing loss occurs when there is damage to the inner ear, or to the nerve pathways from the inner ear to the brain.

Individuals who suffer from conductive hearing loss typically have some form of residual hearing because the hair cells in the cochlea are undamaged. As such, individuals suffering from conductive hearing loss typically receive an auditory prosthesis that generates motion of the cochlea fluid. Such auditory prostheses include, for example, acoustic hearing aids, bone conduction devices, and direct acoustic stimulators.

Bone conduction devices convert a received sound into vibrations that are transferred through a recipient's teeth and/or bone to the cochlea, thereby causing generation of nerve impulses that result in the perception of the received sound. Bone conduction devices are suitable to treat a variety of types of hearing loss and may be suitable for individuals who cannot derive sufficient benefit from acoustic hearing aids, cochlear implants, etc., or for individuals who suffer from stuttering problems. Bone conduction devices may be coupled using a direct percutaneous implant and abutment, or using transcutaneous solutions, which can contain an active or passive implant component, or other mechanisms to transmit sound vibrations through the skull bones, such as through vibrating the ear canal walls or the teeth.

SUMMARY

In one aspect an active bone conduction device is provided. The active bone conduction device comprises an actuator configured to be subcutaneously implanted within a recipient so as to deliver mechanical output forces to hard tissue of the recipient, an audio driver configured to deliver actuator drive signals to the actuator, and an energy recovery circuit configured to extract non-used energy from the actuator and to store the non-used energy for subsequent use by the actuator.

In certain embodiments, the energy recovery circuit comprises at least one energy recovery inductor connected in series between the audio driver and actuator, and an energy recovery tank circuit comprising a rechargeable power supply. The audio driver may be a half H-bridge Class-D circuit or a full H-bridge Class-D circuit.

The at least one energy recovery inductor may comprise first and second energy recovery inductors disposed on opposing sides of the actuator. In one embodiments, the at least one energy recovery inductor may be a low-direct current resistance (DCR) energy recovery inductor having an inductance that is less than approximately 500 microhenrys (μH) and a DCR that is less than approximately 10 ohms.

In further embodiments, the actuator operates as a low-equivalent series resistance (ESR) capacitor having a capacitance of at least approximately 1 microfarad (μf) and an ESR less than approximately 10 ohms. The rechargeable power supply of the energy recovery tank circuit may have a charge capacity of at least 10 times higher than the charge capacity of the low-ESR capacitance of the actuator.

The active bone conduction device may comprise a sigma-delta converter operating in accordance with a scaled sigma-delta quantization threshold value to convert received signals representative of sound into actuator drive signals. The sigma-delta converter is configured to limit a number of pulses in the actuator drive signals when a level of the received signals representative of sound is below a predetermined threshold level. The delta-sigma converter may be a sixteen-bit audio converter and wherein the scaled sigma-delta quantization threshold value is configurable.

The active bone conduction device may comprise an implantable coil configured to receive control data from an external device, wherein the control data comprises the scaled sigma-delta quantization threshold value. The scaled sigma-delta quantization threshold value may be programmable at the external device.

In certain examples, the actuator is a piezoelectric actuator, such as a stacked piezoelectric actuator operating substantially over the audio frequency spectrum. Additionally, one or more mass elements are attached to the actuator to modify output force levels. Furthermore, the actuator may comprise a plurality of actuators. The active bone conduction device may be an active transcutaneous bone conduction device comprising an external sound processing unit with an external sound input element.

In another aspect a transcutaneous active bone conduction device is provided. The transcutaneous active bone conduction device comprises a sigma-delta converter configured to receive audio signals and to convert those audio signals into sigma-delta signals, wherein the sigma-delta converter operates to scale the sigma-delta signals when the audio signals have an amplitude that is below a predetermined threshold level, an implantable actuator comprising a capacitive element, an audio driver configured to deliver the sigma-delta signals to the actuator in a manner that charges and discharges the capacitive element, and an energy recovery circuit configured to extract energy from the capacitive element while the capacitive element discharges and to add energy to the capacitive element while the capacitive element charges.

BRIEF DESCRIPTION OF THE DRAWINGS

Embodiments of the present invention are described herein in conjunction with the accompanying drawings, in which.

DETAILED DESCRIPTION

Presented herein are low-power active bone conduction devices. The low-power active bone conduction devices generally comprise an actuator that is subcutaneously implanted within a recipient so as to deliver mechanical output forces to hard tissue of the recipient. The low-power active bone conduction devices include an energy recovery circuit configured to extract non-used energy from the actuator and to store the non-used energy for subsequent use by the actuator. The low-power active bone conduction devices may also include a multi-bit sigma-delta converter that operates in accordance with a scaled sigma-delta quantization threshold value to convert received signals representative of sound into actuator drive signals.

In certain embodiments, the actuator is a piezoelectric actuator. In other embodiments, the actuator may be, for example, an electromagnetic, magnetostrictive, or a Microelectromechanical systems (MEMS)-based actuator. For ease of illustration, embodiments are primarily described herein with reference to the use of an implantable piezoelectric actuator.

Figure 1:
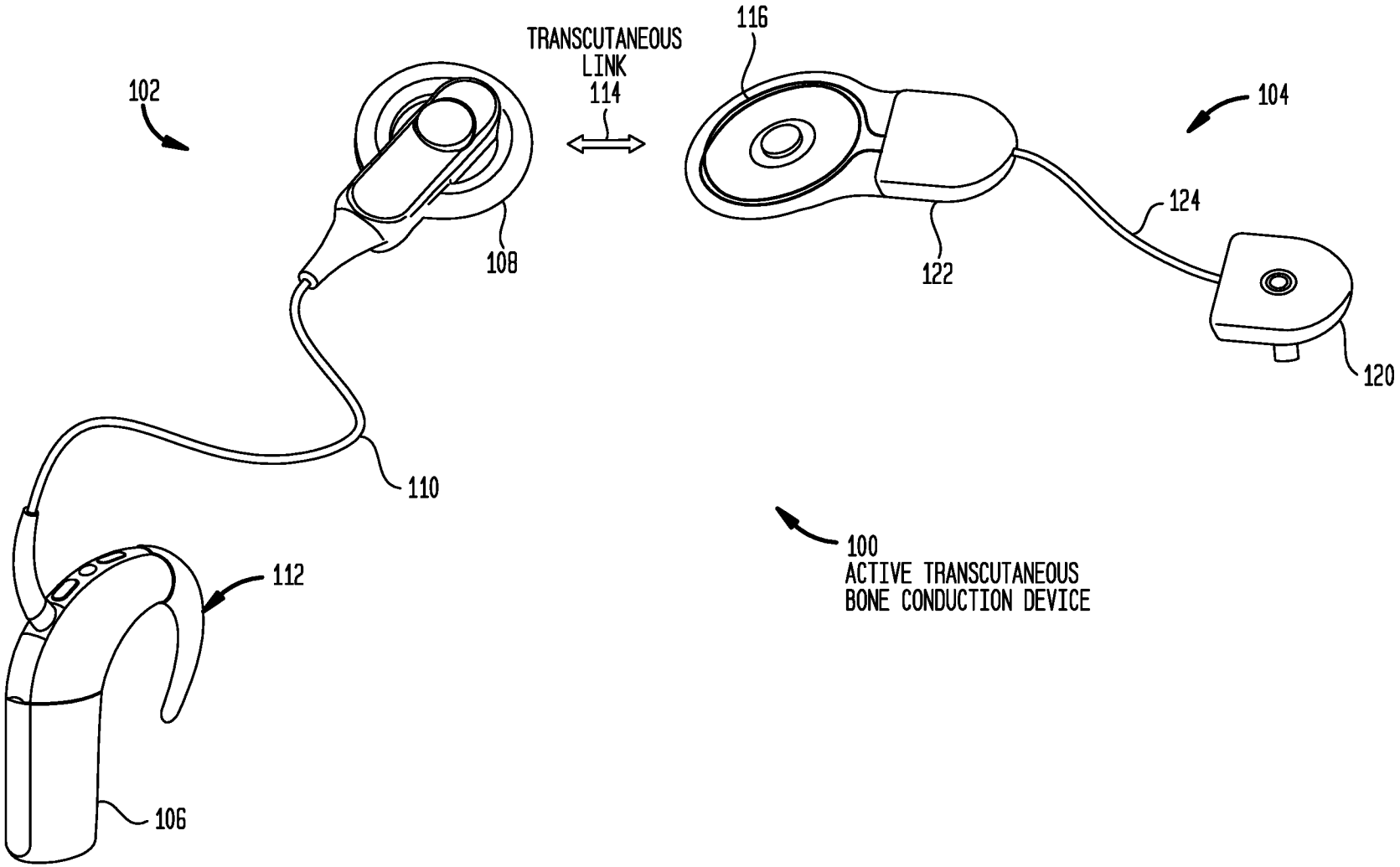
FIG. 1 is a diagram illustrating a low-power active transcutaneous bone conduction device in accordance with embodiments presented herein.

FIG. 1 is a schematic diagram illustrating a first low-power bone conduction device 100 in accordance with embodiments presented herein. The bone conduction device 100 includes an external component 102 and an implantable component 104. The bone conduction device 100 of FIG. 1 is referred to as an "active" transcutaneous bone conduction device because the implantable component 104 includes a subcutaneously implanted actuator/transducer (i.e., the active vibration generation component is implanted within the recipient, rather than positioned externally). The bone conduction device 100 of FIG. 1 is also referred to as a "transcutaneous" device because the device includes the external component 102 that provides data for use in stimulating the hearing of a recipient. As such, low-power bone conduction device 100 is sometimes referred to herein as a low-power active transcutaneous bone conduction device.

The external component 102 is directly or indirectly attached to the body of the recipient and typically comprises an external coil 108 and, generally, a magnet (not shown in FIG. 1) fixed relative to the external coil 108. The external component 102 also comprises one or more sound input elements 112 (e.g., microphones, telecoils, etc.) for receiving sound signals, and a sound processing unit 106. The sound processing unit 106 is electrically connected to the external coil 108 via a cable or lead 110.

In the embodiment of FIG. 1, the sound processing unit 106 is a behind-the-ear sound processing unit. The sound processing unit 106 may include, for example, a power source (not shown in FIG. 1) and a sound processor (also not shown in FIG. 1). The sound processor is configured to process electrical signals generated by the sound input element 112.

FIG. 1 illustrates an example in which bone conduction device 100 includes an external component 102 with an external sound processor. It is to be appreciated that the use of an external component is merely illustrative and that the techniques presented herein may be used in arrangements having an implanted sound processor, an implanted microphone, and/or an implanted power source (battery). It is also to be appreciated that the individual components referenced herein, e.g., sound input elements, the sound processor, etc., may be distributed across more than one device, e.g., two bone conduction devices, and indeed across more than one type of device, e.g., a bone conduction device and a consumer electronic device or a remote control of the bone conduction device.

The implantable component 104 comprises an implantable coil 116 and, generally, a magnet (not shown) fixed relative to the internal coil 116. The magnets adjacent to the external coil 108 and the implantable coil 116 facilitate the operational alignment of the external and implantable coils. The operational alignment of the coils enables the external coil 108 to transcutaneously transmit/receive power and data to/from the implantable coil 116. More specifically, in certain examples, external coil 108 transmits electrical signals (e.g., power and data) to implantable coil 116 via a transcutaneous radio frequency (RF) link 114. External coil 108 and implantable coil 116 are typically wire antenna coils comprised of multiple turns of electrically insulated single-strand or multi-strand platinum or gold wire. The electrical insulation of implantable coil 116 is provided by a flexible silicone molding. It is to be appreciated that various other types of energy transfer, such as infrared (IR), electromagnetic, capacitive and inductive transfer, may be used to transfer the power and/or data from external component 102 to implantable component 104 and that FIG. 1 illustrates only one example arrangement.

The implantable coil 116 is electrically connected to an electronics assembly 122 that is electrically connected to an actuator assembly 120 via a lead (e.g., two-wire lead) 124. In certain embodiments, the actuator assembly 120 includes a piezoelectric actuator (not shown in FIG. 1) configured to deliver mechanical output forces (vibration) to the recipient's hard tissue (e.g., bone or other tissue). More specifically, the electronics assembly 122 uses the data received from the external component 102 to generate actuator drive signals. When delivered to the piezoelectric actuator, the actuator drive signals cause the piezoelectric actuator to generate vibration signals (vibration) that are transferred through a recipient's tissue and/or bone to the cochlea, thereby causing generation of nerve impulses that result in the perception of the sound signals received by the sound input element 112. As described further below, the implantable component 104 is a low-power device configured to execute power-conservation techniques to reduce, relative to conventional arrangements, the power consumed as a result of delivery of vibration to the recipient via the piezoelectric actuator.

Figure 2:
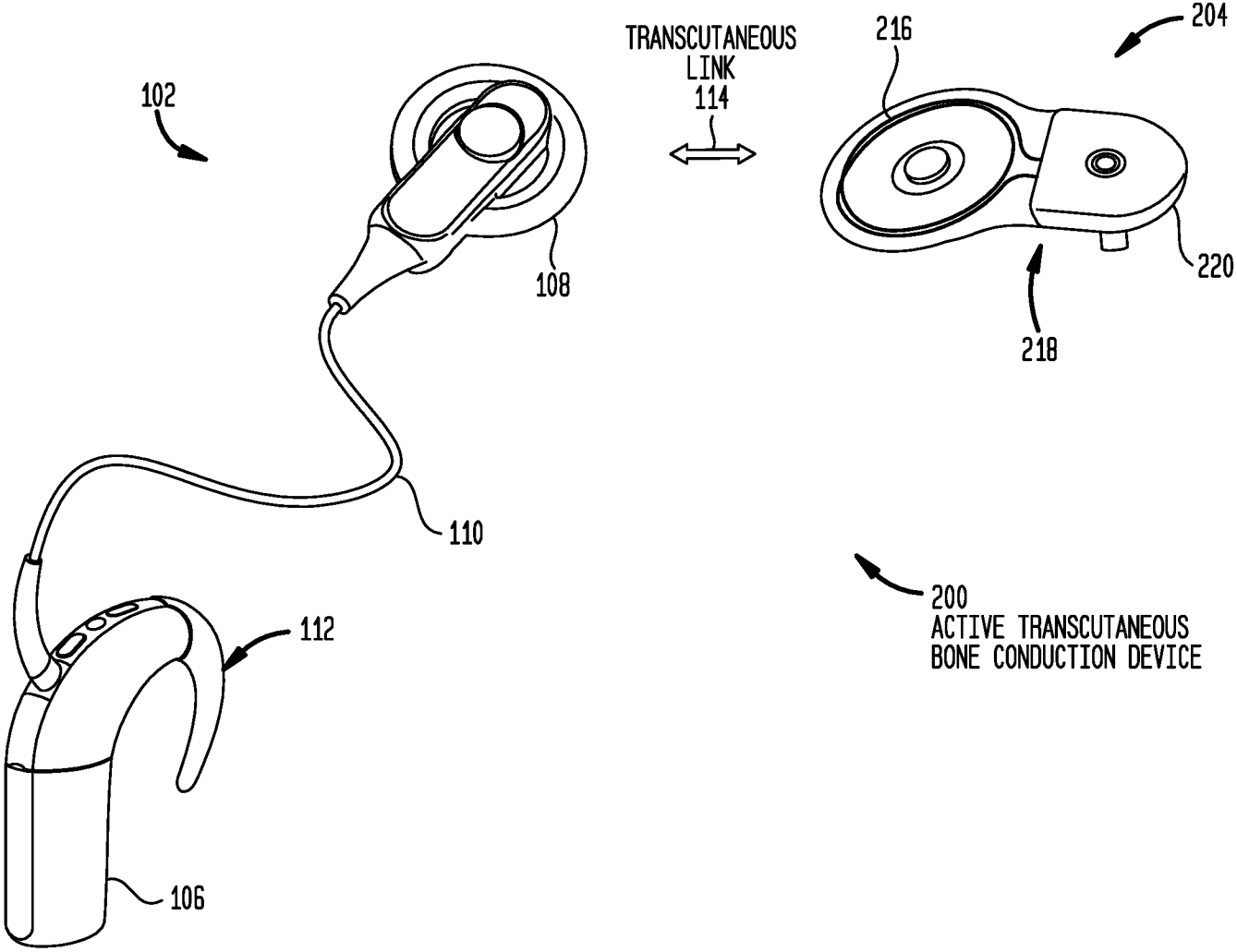
FIG. 2 is a diagram illustrating another low-power active transcutaneous bone conduction device in accordance with embodiments presented herein.

It is to be appreciated that a low-power active transcutaneous device in accordance with embodiments of the present invention may have a number of different arrangements. For example, FIG. 2 illustrates a monolithic arrangement for a low-power active transcutaneous bone conduction device 200 where the external component 102 (FIG. 1) operates with an alternative implantable component 204. The implantable component 204 comprises an implantable coil 216 electrically connected to an electronics assembly (not shown in FIG. 2) that is embedded within an actuator assembly 220 (i.e., the electronics assembly and the actuator assembly 220 are disposed within the same housing). In certain embodiments, the actuator assembly 220 includes a piezoelectric actuator. Similar to the arrangement of FIG. 1, the implantable component 204 is a low-power device configured to execute power-conservation techniques to reduce, relative to conventional arrangements, the power consumed as a result of delivery of vibration signals to the recipient via the piezoelectric actuator.

Figure 3:
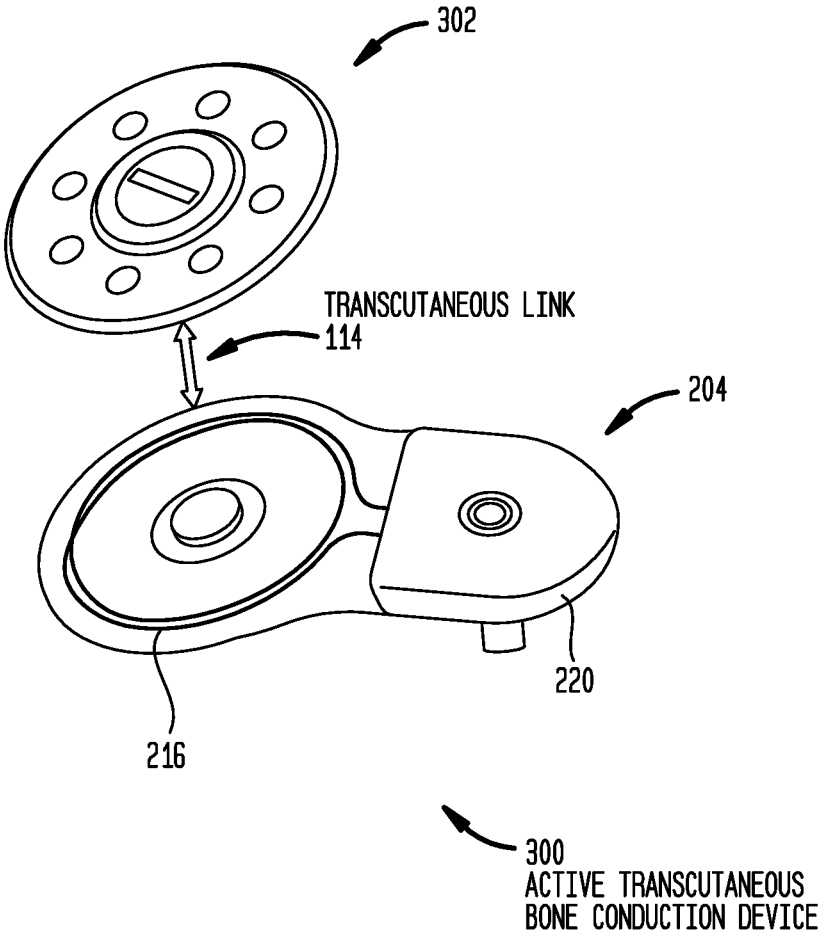
FIG. 3 is a diagram illustrating a further low-power active transcutaneous bone conduction device in accordance with embodiments presented herein.

FIG. 3 illustrates an arrangement for a low-power active transcutaneous bone conduction device 300 where the implantable component 204 (FIG. 2) operates with an alternative external component 302. The external component 302 is a coil sound processing unit having, for example, a generally cylindrical shape. In the embodiment of FIG. 3, the sound input element, sound processor, external coil, and external magnet (all not shown in FIG. 3) are disposed within (or adjacent to) the same housing configured to be worn at the same location as where an external coil is traditionally located. The external component of 302 is sometimes referred to herein as a coil sound processing unit 302

Figure 4:
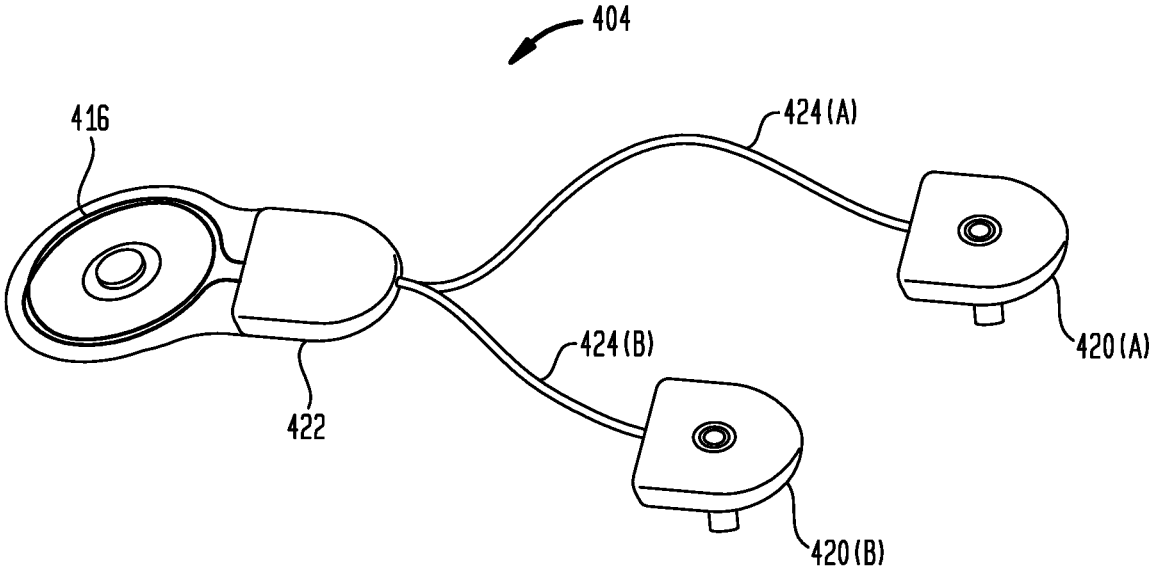
FIG. 4 is a diagram illustrating another low-power active transcutaneous bone conduction device in accordance with embodiments presented herein.

FIG. 4 illustrates an arrangement for an implantable component 404 of a low-power active transcutaneous bone conduction device in accordance with further embodiments of the present invention. The implantable component 404 comprises an implantable coil 416 electrically connected to an electronics assembly 422. The electronics assembly 422 is electrically connected to a first actuator assembly 420(A) via a first lead 424(A). The electronics assembly 422 is also connected to a second actuator assembly 420(B) via a second lead 424(B). In certain embodiments, the actuator assemblies 420(A) and 420(B) each include piezoelectric actuators. As described further below, the implantable component 404 is a low-power device configured to execute power-conservation techniques to reduce, relative to conventional arrangements, the power consumed as a result of delivery of vibration to the recipient via the piezoelectric actuator.

FIGS. 1-4 generally illustrate examples of transcutaneous active bone conduction devices that include an external component with an external sound processor. It is to be appreciated that the use of an external component is merely illustrative and that the techniques presented herein may be used in arrangements having an implanted sound processor (e.g., totally or mostly implantable active bone conduction devices). Such embodiments may be referred to as active bone conduction devices, but do not necessarily rely upon a transcutaneous transfer of data for operations. It is also to be appreciated that the individual components referenced herein, e.g., sound input element and the sound processor, may be distributed across more than one device, e.g., two bone conduction devices, and indeed across more than one type of device, e.g., a bone conduction device and a consumer electronic device or a remote control of the bone conduction device.

Merely for ease of illustration, further details of low-power transcutaneous bone conduction devices in accordance with embodiments of the present invention will be described with reference to the arrangement of FIG. 1. However, it is to be appreciated that the embodiments presented herein may be implemented in any of the above or other bone conduction devices.

Figure 5:
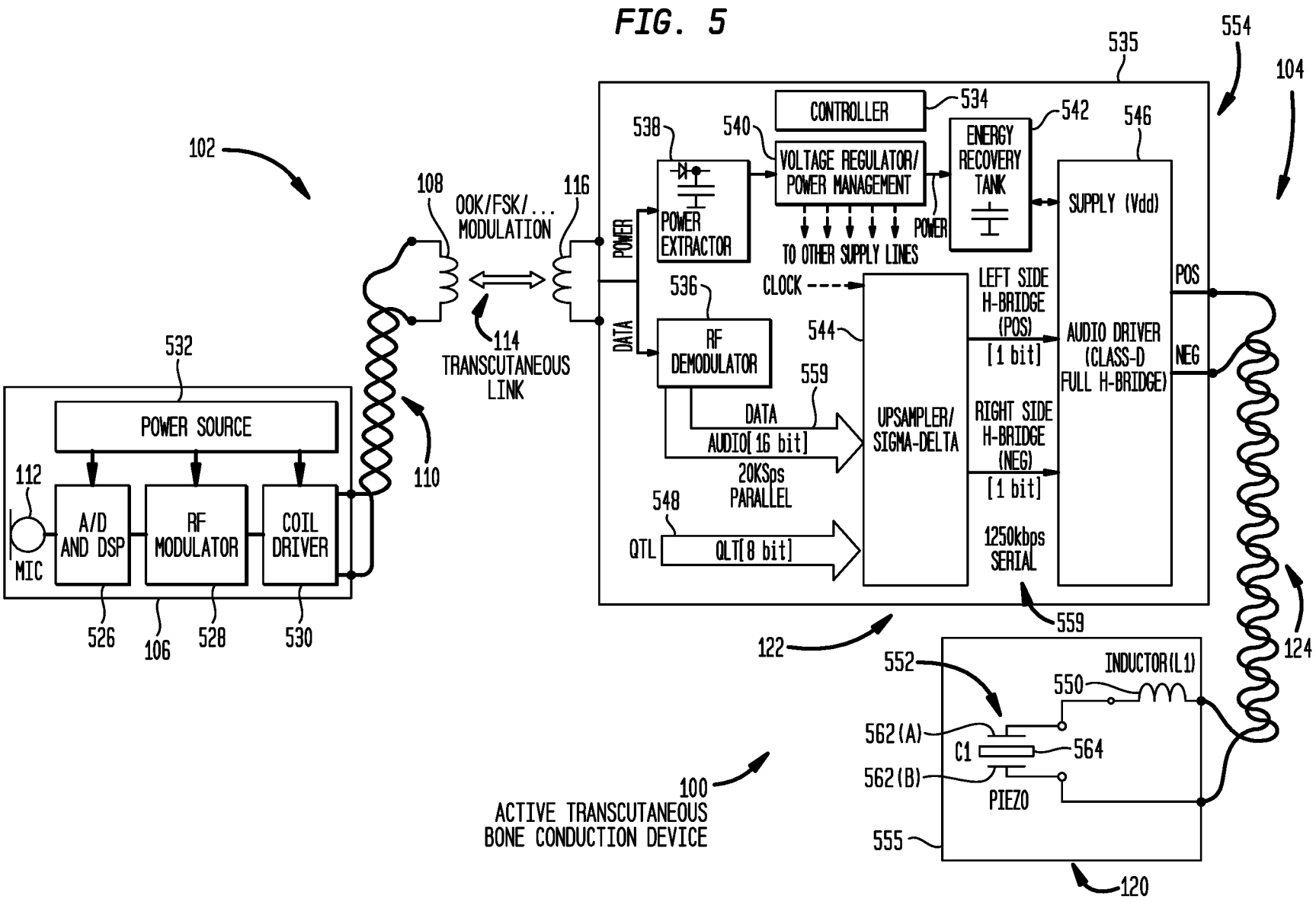
FIG. 5 is a block diagram illustrating further details of the low-power active transcutaneous bone conduction device of FIG. 1.

FIG. 5 is a schematic diagram illustrating further details of low-power active transcutaneous bone conduction device 100 of FIG. 1. FIG. 5 illustrates that the sound processing unit 106 comprises the sound input element 112 in the form of a microphone, a sound processor 526 (e.g., an analog-to-digital (A/D) converter and a digital signal processor), an RF modulator 528, a coil driver 530, and a power source 532. The sound input element 112 is configured to receive sound signals and output electrical signals representative of the received sound signals. The sound processor 526 processes these electrical signals and the RF modulator 528 and the coil driver 530 are configured to encode and transcutaneously transmit the processed electrical signals to the implantable component 104 via the cable 110 and the coil 108. The RF modulator 528 and the coil driver 530 are also configured to transcutaneously transmit power to the implantable component 104 via the cable 110 and the coil 108.

The power and data transmitted by the external component 102 is received at the implantable coil 116 for forwarding to the electronics assembly 122. The electronics assembly 122 comprises a controller 534, an RF demodulator 536, a power extractor 538, a voltage regulator/power management module (power management module) 540, an energy recovery tank circuit 542, a multi-bit sigma-delta (delta-sigma) converter (with integrated upsampler) 544, and an audio driver circuit (audio driver) 546 disposed within housing 535.

The power extractor 538 extracts the power from the signals received at the implantable coil 116 and provides the power to the power management module 540. The power management module 540 may include a rechargeable power supply such as a rechargeable battery. The data within the signals received at the implantable coil 116 are provided to the RF demodulator 536.

The electronics assembly 122 is electrically connected to the actuator assembly 120 via the two-wire lead 124. The actuator assembly 120 comprises a piezoelectric actuator 552 and an energy recovery inductor (LI) 550. The piezoelectric actuator 552 comprises segments of parallel conductive plates or electrodes 562(A) and 562(B) that are separated by piezoelectric material 564 (e.g., lead zirconium titanate (PZT), barium titanate (BaTiO30), zirconium (Zr), quartz (SiO2), Berlinite (AlPO4), Gallium orthophosphate (GaPO4), Tourmaline, etc.) that forms a dielectric layer between the conductive plates. The piezoelectric material 664 is a capacitive element and is configured to convert electrical signals applied thereto into a mechanical deformation (i.e. expansion or contraction) of the material. That is, by applying a voltage over the conductive plates, a mechanical force is introduced in the piezoelectric material 664 that causes the piezoelectric material 564 (i.e., the mechanical position state of the piezoelectric material will change from an initial state). As such, the electrical energy applied to the piezoelectric material 564 is, at least in part, transferred into mechanical energy.

The piezoelectric actuator 552 operates as a large low-Equivalent series resistance (ESR) capacitor having high capacitance (i.e., the piezoelectric actuator 552 includes a capacitive element). A high capacitance actuator 552 provides high-output force (OFL) at relative low voltages on the outputs of the audio driver 546. The use of low implant voltages is preferred as they avoid potential high leakage currents causing tissue damage (hazard analysis). Low ESR reduces resistive losses caused by the alternating currents on the piezoelectric actuator.

In certain embodiments, the piezoelectric actuator 552 operates as a large low-ESR capacitor having a capacitance of at least approximately 1 microfarad (g) and an ESR less than approximately 10 ohms. In general, the capacitance of the piezoelectric actuator 552 may be slightly below 2uF.

The piezoelectric actuator 552 may be a flat piezoelectric actuator. The flat piezoelectric actuator may, in certain embodiments, be a piezoelectric stacked actuator operating substantially over the audio frequency spectrum or a piezoelectric bending actuator operating substantially over the audio frequency spectrum. In certain embodiments, one or more mass elements may be directly coupled (attached) to the piezoelectric material 564 to modify output force levels.

As shown, the energy recovery inductor 550 is connected in series between the audio driver 546 and the piezoelectric actuator 552. The energy recovery inductor 550 is a low-DC resistance (DCR) (i.e., low DC resistance and/or losses) energy recovery device. In certain embodiments, the small low-DCR energy recovery inductor 550 has an inductance that is smaller than 500 μH and a DCR that is less than 10 ohms.

As described further below, the energy recovery inductor 550, along with the energy recovery tank circuit 542, form an energy recovery circuit 554 configured to extract charge from, and add charge to, the piezoelectric actuator 552. In general, the inductor 550 provides a voltage boost that enables the charge recovery.

FIG. 5 illustrates an example arrangement where one energy recovery inductor 550 is present. It is to be appreciated that the use of one energy recovery inductor is merely illustrative and that other arrangements are possible. For example, in one alternative arrangement first and second energy recovery inductors may be disposed on opposing sides of the piezoelectric actuator 552. That is, in such arrangements the first and second energy recovery inductors connect opposing sides of the piezoelectric actuator 552 to the audio driver 546.

The energy recovery inductor 550 and the piezoelectric actuator 552 are disposed within a housing 555 (i.e., the energy recovery inductor is disposed within the actuator assembly). The actuator 552 is mechanically coupled to the housing 55 which is substantially rigidly attached to the recipient's hard tissue.

In operation, the data received at the implantable coil 116 is provided to RF demodulator 536 for decoding. The RF demodulator 536 generates a parallel audio output (e.g., sixteen (16) bit output) 557. The parallel audio output 557 is provided to the multi-bit sigma-delta (delta-sigma) converter (modulator) 544. The sigma-delta converter 544 uses the parallel audio output 557 to generate a serialized sigma-delta output 559 provided to audio driver 546. The sigma-delta output 559 comprises a series of pulses, referred to as sigma-delta pulses. As described further below, the sigma-delta converter 548 operates in accordance with a scaled sigma-delta quantization threshold value so as to limit the number of sigma-delta pulses generated when the audio signal (i.e., audio output 557) is below a certain amplitude.

The sigma-delta output 559 is used by the audio driver 546 to drive the piezoelectric actuator 552 (i.e., cause vibration of the piezoelectric actuator). The audio driver 546 drives the piezoelectric actuator 552 in a manner that produces vibration of the recipient's hard tissue (e.g., bone) that causes perception of the sound signals received at the sound input element 112.

In the arrangement of FIG. 5, the active bone transcutaneous bone conduction device 100 is configured to implement two power-conservation techniques that reduce the power consumption of the device so as to make the active bone transcutaneous bone conduction device 100 a "low-power" device relative to conventional devices. In particular, the active bone transcutaneous bone conduction device 100 includes energy recovery techniques that recover charge from the piezoelectric actuator 552 and sigma-delta quantization threshold scaling techniques that limit the number of sigma-delta pulses generated when the amplitude of the audio signal (i.e., audio output 557) is below a certain audio threshold level. Each of these power-conservation mechanisms is described in detail below with continued reference to the arrangement of FIG. 5.

Referring first to the sigma-delta quantization threshold scaling techniques, as noted above, the active transcutaneous bone conduction device 100 includes a multi-bit sigma-delta converter 544 that is configured to operate in accordance with a scaled sigma-delta quantization threshold value to reduce power at lower audio levels. The sigma-delta converter 544 receives a parallel audio output 557 from the RF demodulator 536. In one embodiment, the digital parallel audio output 557 consists of audio samples at 20 kilo-Samples-per-second (KSps) with a 16-bit audio resolution (i.e., 16 bit parallel output). The sigma-delta converter 544 includes an upsampler as can be implemented in, for example, Very High Speed Integrated Circuit (VHSIC) Hardware Description Language (VHDL) code (digitized). In operation, the sigma-delta converter 544 converts the lower audio sampling rate (e.g, 20 KSps) into a high frequency 1-bit serialized bitstream of, for example, 1250 bits per second. That is, the output 559 of the sigma-delta converter 559 is a serialized bit stream of pulses (left-side and right-side) going to the H-bridge audio driver.

As shown in FIG. 5, these pulses are provided to different portions of the audio driver 546 (i.e., the left-side pulses (POS) are delivered to one half of the audio driver, while right-side pulses (NEG) are delivered to another half of the audio driver). The sigma-delta converter 544 may be, for example, of the $5^{th}$ order. In certain embodiments, the sigma-delta output 559 has three levels instead of two (i.e., −1, 0 and +1). Table 1, below, illustrates combinations of these output and the resulting outputs of the audio driver 546

TABLE 1

| Output of Sigma-Delta Converter | 'NEG' output of audio driver | 'POS' output of audio driver |
|---|---|---|
| −1 | 0 | 1 |
| 0 | 0 | 0 |
| +1 | 1 | 0 |

Adding the additional level (0') (i.e., adding a $3^{rd}$ output level) leads to an improvement in noise.

As shown in FIG. 5, the sigma-delta converter 544 includes an extra input that is used to set the scaled quantization threshold level (QTL) 548 (e.g., an eight (8) bit input). The scaled quantization threshold level is set in order to reduce the number of output pulses generated by the sigma-delta converter 544 when the amplitude of the audio signal (i.e., audio output 557) is below a certain level. That is, scaling of the sigma-delta pulses occurs when the amplitude of the audio signal is below a certain threshold level (i.e., when there is audio silence (quiescent) or lower audio levels).

The scaled sigma-delta quantization threshold value limits the number of sigma-delta pulses provided to the audio driver, and thus reduces the power consumption of the audio driver 546 and the piezoelectric actuator 552. More specifically, the reduction in the sigma-delta pulses lowers the losses of the audio driver 546 and the piezoelectric actuator 552 because the audio driver has less switching losses (i.e., capacitive in nature). Moreover, less sigma-delta pulses means less current flow, thereby reducing any conductive losses (i.e., resistive in nature).

Once the audio signal has an amplitude that is greater than the audio threshold level, the sigma-delta converter 544 operates normally (i.e., does not limit the number of sigma-delta pulses output to the audio driver). It is to be appreciated that the audio threshold level may be set at a number of different levels. The lower the audio threshold level is set, the less the sigma-delta converter 544 will operate to scale the sigma-delta output 559 and less power-conservation will occur. The higher the audio threshold level is set, the more the sigma-delta converter 544 will operate to scale the sigma-delta output 559 and more power-conservation will occur. It is to be appreciated that scaling the sigma-delta output 559 distorts any audio present, thus the audio threshold level may be set at a level that is high enough to provide power-conservation, but sufficiently low to have limited or no impact on hearing performance. As such, the audio amplitude level that triggers the scaling of the sigma-delta pulses may be different for different recipients and could be set, for example, by a clinician, audiologist, or other user.

As noted, the scaled sigma-delta quantization threshold value is introduced to reduce the number the number of output pulses generated by the sigma-delta converter 544 and thus reduce the number of transitions at the audio driver 546 (i.e., the rising and falling slopes and charging/discharging of the piezoelectric actuator 552). In practice, this may result in a reduction of up to four times the power consumption of the loaded audio driver. There are a number of ways to scale the sigma-delta output to reduce the number of transitions at the audio driver 546. For example, in a first method, portions of the audio signal 557 below a predefined threshold level are not or scarcely applied to the sigma-delta modulator. Once the amplitude of the input signals exceeds the audio threshold level, all 16 audio bits are used by the sigma-delta converter. This method increases distortion for low audio levels. In practice the distortion is measured at higher audio levels.

A second method uses dynamic hysteresis in the processing loop to reduce the output transition rate. Adding a hysteresis level (H) to the quantizer reduces the transition rate, because integrators within the sigma-delta converter integrate until the output crosses+/−H (instead of 0). Other methods are possible and should be considered within the scope of the present invention.

The scaled sigma-delta quantization threshold value is set at a certain level that can depending on the quantization. For example, in certain embodiments, the sigma-delta converter 544 is a 16-bit (16-bit audio resolution) converter where the scaled sigma-delta quantization threshold value is set to 4 Least Significant Bits (LSB's).

Different scaled sigma-delta quantization threshold values can be set as a static variable as needed based on, for example, operations of the implantable component, type of hearing loss, actuator type, etc. The highest audio quality is for a scaled sigma-delta quantization threshold value set to zero (i.e., QTL=0), but such a lower level substantially eliminates power conservation. A high scaled sigma-delta quantization threshold setting (i.e., QTL=30) results in higher distortion levels at low audio, but improves power saving.

The implantable coil 116 may be configured to receive control data from an external device (e.g., the external component 102 or other devices such as a remote control, fitting equipment, etc.). The scaled sigma-delta quantization threshold for use by the sigma-delta converter 544 may be part of the control data provided by the external device. In other words, the scaled sigma-delta quantization threshold can be programmed by the external device and may be latched in the implantable portion. Therefore, the sigma-delta quantization threshold can be "scaled" to the application.

Figure 6:
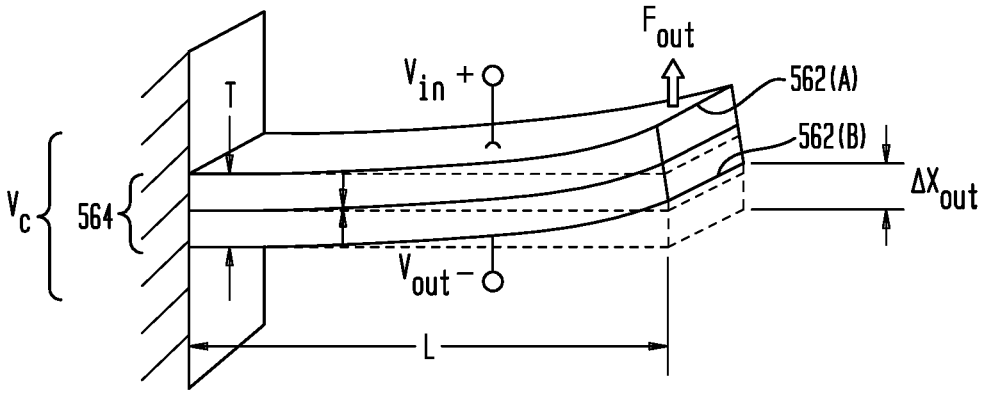
FIG. 6 is a diagram illustrating piezoelectric material forming part of a piezoelectric actuator.

Referring next to the energy recovery techniques, FIG. 6 is a schematic diagram illustrating operation of the piezoelectric material 564 that forms part of the piezoelectric actuator 552 of FIG. 5. As noted, the piezoelectric material 564 is configured to convert electrical signals applied thereto into a mechanical deformation of the material. The amount of deformation of a piezoelectric material 563 in response to an applied electrical signal may depend on, for example, the inherent properties of the material, orientation of the electric field with respect to the polarization direction of the piezoelectric material, geometry of the piezoelectric material, etc. Reinforced mechanical motion may be produced by grouping identical layers of electrodes interleaved with piezoelectric material. In particular, the segments may be interconnected mechanically in series (sum of mechanical forces) and connected electrically in parallel so as to produce the mechanical motion.

The voltage over the capacitor plates 562(A) and 562(B) is directly related to the charge 'q,' assuming, for ease of illustration, the capacitance 'C' is considered constant. In practice, some small variations of C may occur due to voltage, load and temperature differences. Assuming C is constant, the linear relationship between q and the voltage over the capacitor plates '$V_c$' can be written as shown in below in Equation 1:

$$q(t) = C \cdot v_c(t) \quad \text{Equation 1}$$

The actuators position 'x' (deformation) is related to the voltage or charge content.

Figure 7:
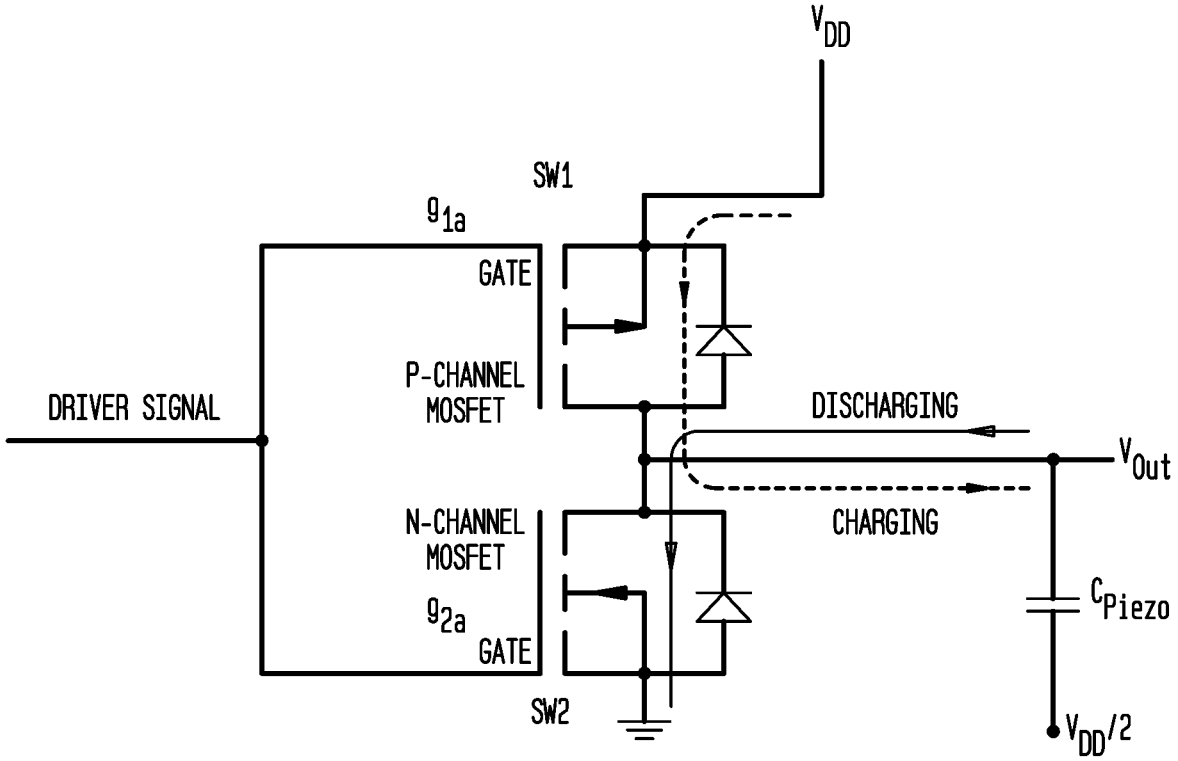
FIG. 7 is a schematic diagram illustrating current flow in an arrangement that does not include an energy recovery circuit.

FIG. 7 illustrates an arrangement that lacks energy recovery capabilities. That is, in FIG. 7 the energy recovery circuit 554 of FIG. 5 is not present and thus the illustrative arrangement of FIG. 7 lacks the ability to recovery energy from the piezoelectric actuator (although the sigma-delta scaling techniques as described above may still be used). In this specific arrangement of FIG. 7, an audio driver is configured as a half H-bridge Class-D circuit having complementary N-channel MOSFET (SW2) and P-channel MOSFET (SW1) MOSFET used as ideal switches and controlled by sigma-delta pulses at a sigma-delta rate of, for example, 1250 kbps. The actuator of FIG. 7 is a piezoelectric actuator represented as '$C_{Piezo}$.'

The sigma-delta drive signals on the Class-D switches cause a charge displacement (AQ=I·ΔT) to/from the piezoelectric material, allowing the voltage over the piezoelectric material to raise or drop (as the piezoelectric material is a large capacitor (AQ=C·ΔV)). It is seen that $C_{Piezo}$ charges to $V_{DD}$ through SW1 and discharges to ground through SW2. During charging, energy equal to approximately half of $C_{Piezo}$ $V_{DD}^2$ is lost in the pull up circuit, while during discharging energy equal to approximately half of $C_{Piezo}$ $V_{DD}^2$ (which was stored in the capacitor) is lost to the ground. Thus, in one cycle of charge and discharge, energy equal to $C_{Piezo}$ $V_{DD}^2$ is dissipated. If the output is switching at a frequency (f) and the switching activity is α, then the dynamic power dissipation (P) is given below in Equation 2:

$$P = \alpha C_L V_{DD^2 f} \quad \text{Equation 2}$$

Assuming that α=1, $C_{Piezo}$=2 μF, $V_{DD}$=3.0V and f=1 kHz (sigma-delta output=1250 kbps with consecutive single series of '1' and single series of '0' at a rate of 1 kHz), then P equals 18 mW. Assuming that α=1, $C_{Piezo}$=2 μF, $V_{DD}$=3.0V and f=625 kHz (sigma-delta output=1250 kbps with alternating '1' and '0'), then P equals 11.25 W.

Figure 8:
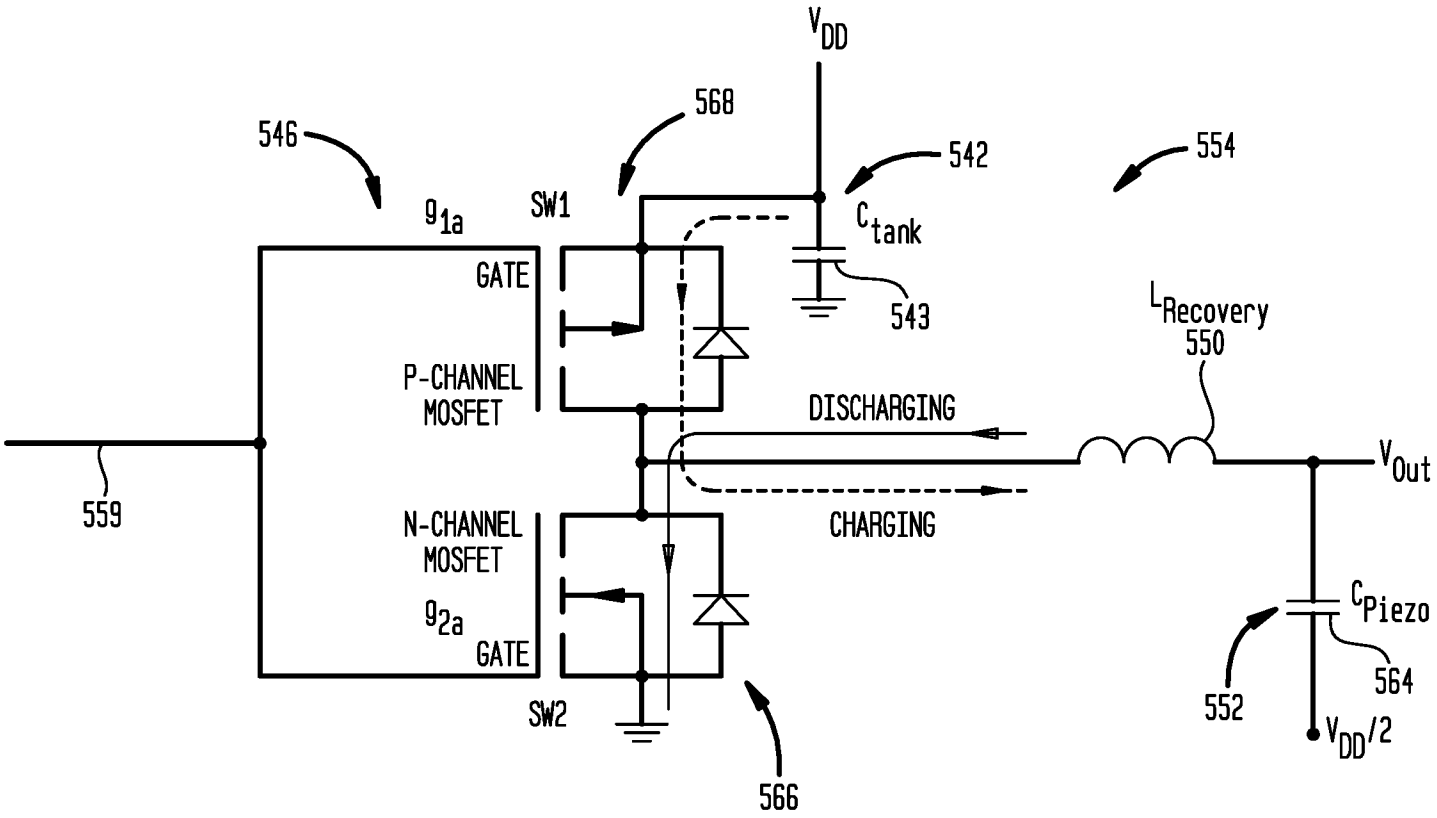
FIG. 8 is a schematic diagram illustrating current flow in an arrangement that includes an energy recovery circuit in accordance with embodiments presented herein.

FIG. 8 is schematic diagram illustrating further details of audio driver 546 of FIG. 5 during implementation of energy recovery techniques in accordance with embodiments of the present invention. The audio driver 546 may be configured as a half or full H-bridge Class-D circuit. FIG. 8 illustrates a specific arrangement in which the audio driver 546 is a half H-bridge with complementary N-channel MOSFET (SW2) 566 and P-channel MOSFET (SW1) 568 used as ideal switches and controlled by sigma-delta pulses (part of sigma-delta signals 559 produced by sigma-delta converter 544) at a sigma-delta rate of, for example, 1250 kbps. The piezoelectric actuator 522 is represented by '$C_{Piezo}$' and is in series with energy recovery inductor 550 represented by '$L_{Recovery}$.' The energy recovery inductor $L_{Recovery}$ has low-DCR and represents medium to high impedance at the sigma-delta rate. FIG. 8 also illustrates the energy recovery tank 542 comprising a tank capacitor 543 represented as '$C_{tank}$.'

The piezoelectric actuator 552 is a nearly ideal capacitor (100 nF to 10 μF) that builds up or releases electrical charge following the raising or descending slope of an incoming audio drive signal. A raising slope of the incoming audio drive signal will proportionally close SW2, while a descending slope of the incoming audio signal will proportionally close SW1.

If the sigma-delta output 559 is switching at frequency (f) and the switching activity is α, then the dynamic power dissipation is reduced due to energy exchange between $C_{Piezo}$ and $C_{tank}$ caused by the presence of the energy recovery inductor 550.

Figure 9A:
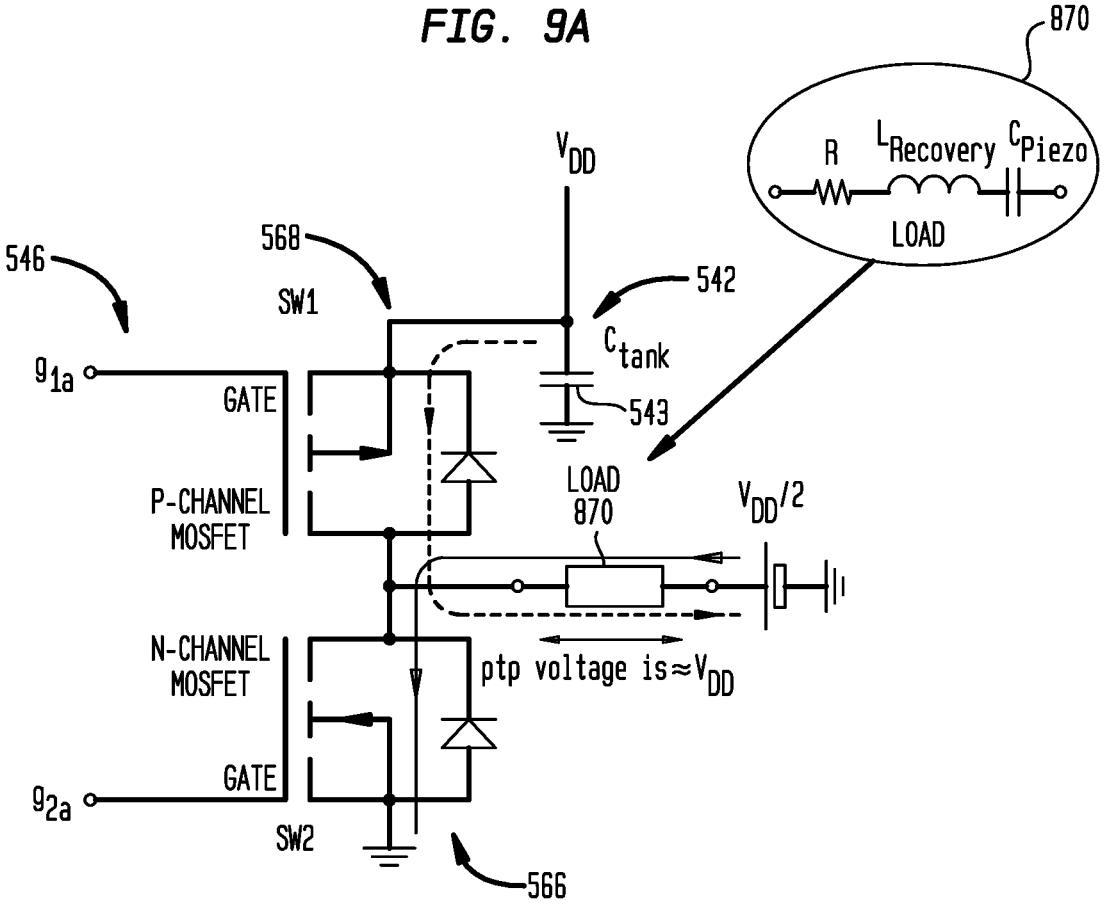
FIG. 9A illustrates current flow through a half H-bridge audio driver in accordance with embodiments presented herein.
Figure 9B:
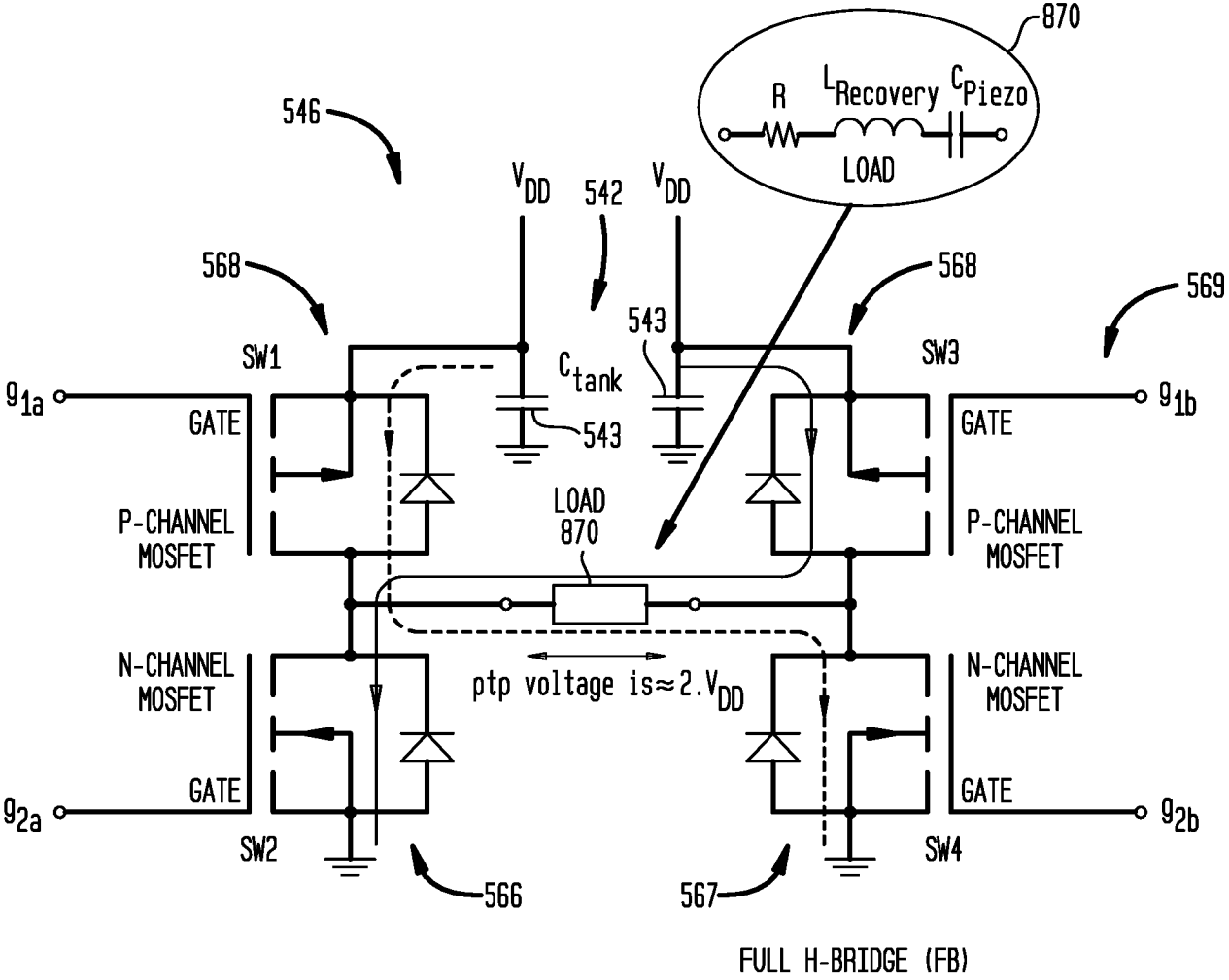
FIG. 9B illustrates current flow through a full H-bridge audio driver in accordance with embodiments presented herein.

FIG. 9A is an alternative schematic representation of the half H-bridge implementation of FIG. 8, while FIG. 9B is a schematic representation of a full H-bridge implementation. FIG. 8 represents a load 870 that encompasses the energy recovery inductor 550 ($L_{Recovery}$) a resistance 'R,' and the piezoelectric actuator 552 ($C_{Piezo}$). In the full-H-bridge implementation of FIG. 9B, the audio driver 564 includes the complementary N-channel MOSFET (SW2) 566 and P-channel MOSFET (SW1) 568, as well as complementary N-channel MOSFET (SW4) 567 and P-channel MOSFET (SW3) 569. The complementary N (SW2, SW4) and P (SW1, SW3) channel-MOSFETS are used as ideal switches controlled by sigma-delta pulses in sigma-delta output 559 at a sigma-delta rate of, for example, 1250 kbps.

In the embodiments of FIGS. 9A and 9B, the peak-to-peak voltage is two (2) times $V_{DD}$ over the load 870 connected to the full H-bridge audio driver when compared to the half H-bridge implementation. The voltages over R and $L_{Recovery}$ are lower as the impedances (Z) of R and $L_{Recovery}$ are lower than the impedance of $C_{Piezo}$. As such, the energy recovery techniques presented herein operate with the half or full H-bridge implementations. For ease of illustration, further details of the energy recovery techniques are described with reference to a half H-bridge implementation.

In a half H-bridge implementation, only one switch (i.e., either S1 or S2) at a time turns 'ON,' thereby avoiding cross conduction currents flowing through both switches. It is assumed that $C_{Piezo}$ is biased at half of VDD (VDD/2).

Figure 10A:
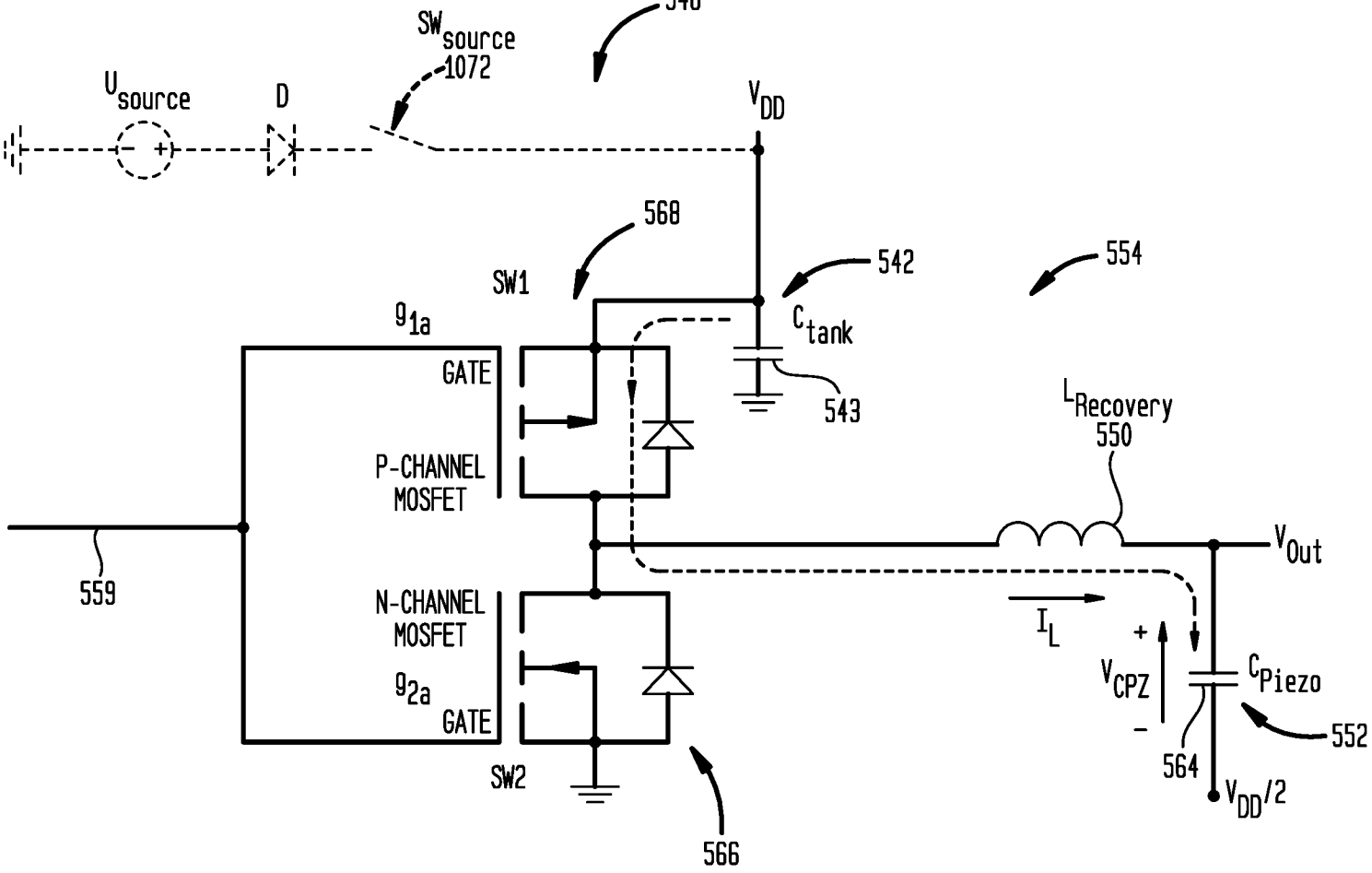
FIG. 10A is a schematic diagram illustrating current flow through a half H-bridge audio driver during a first part of a charging phase of a piezoelectric actuator in accordance with embodiments presented herein.
Figure 10B:
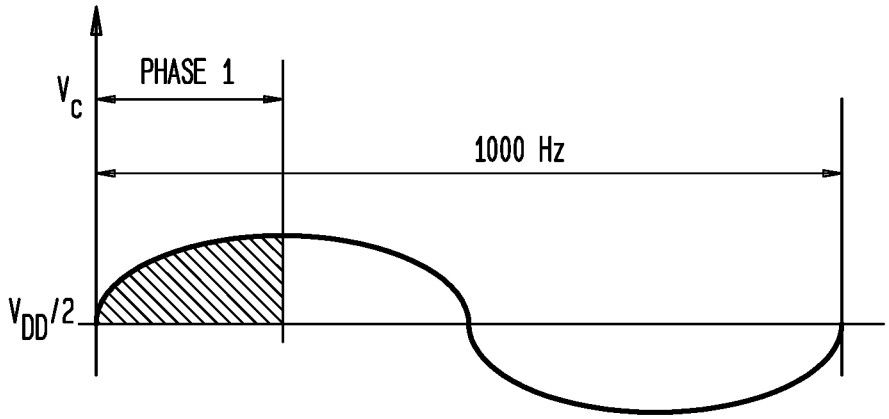
FIG. 10B illustrates a smoothened sigma-delta audio signal over the piezoelectric capacitor that is provided by the half H-bridge audio driver of FIG. 10A.
Figure 10C:
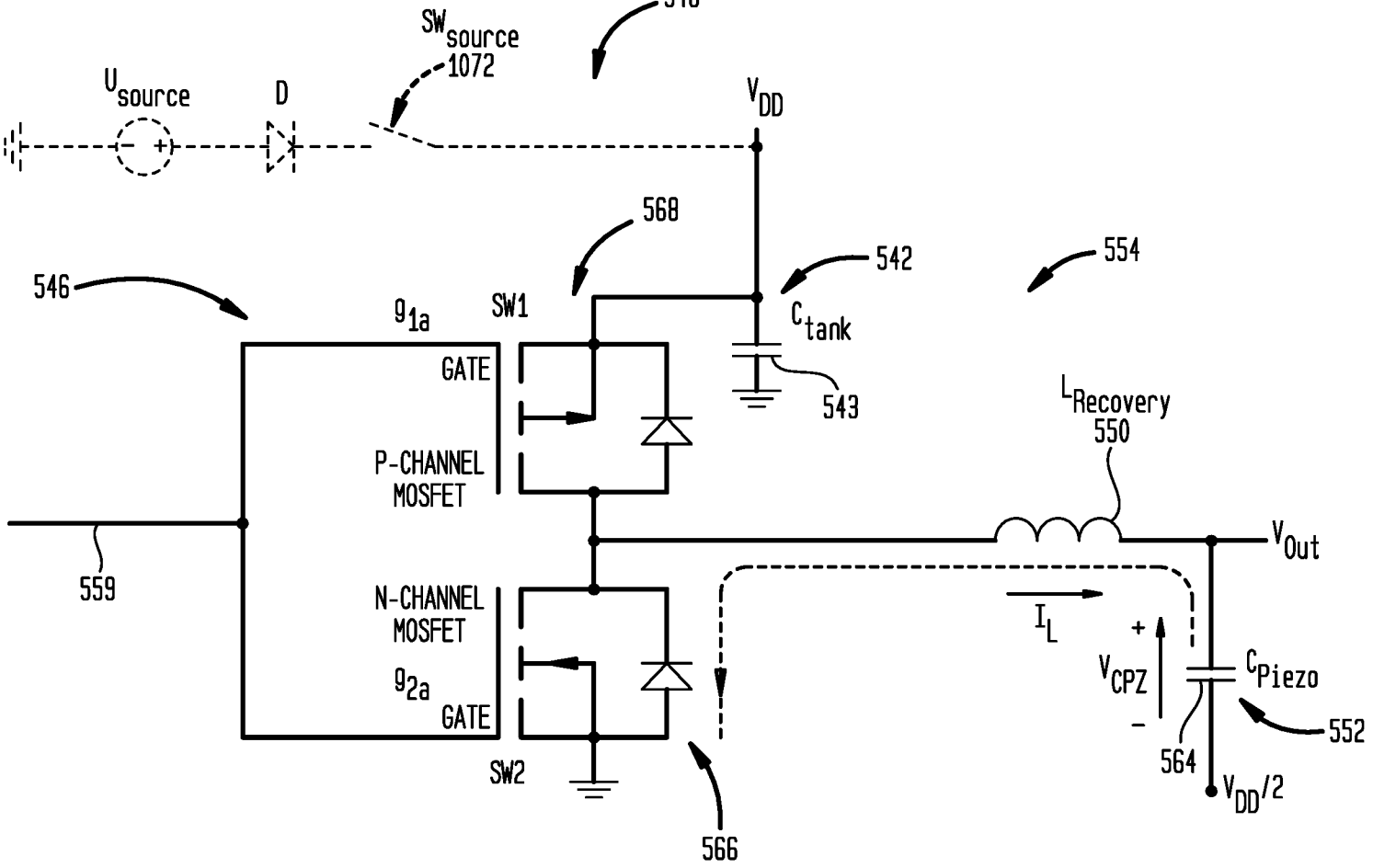
FIG. 10C is a schematic diagram illustrating current flow through the half H-bridge audio driver of FIG. 10A during a second part of the charging phase of the piezoelectric actuator in accordance with embodiments presented herein.

In a first phase, shown in FIGS. 10A-10C, the piezoelectric actuator (capacitor) 552, is charged. This first phase is sometimes referred to herein as the "capacitor charging phase" or simply the "charging phase."

As noted, the piezoelectric actuator 552 operates as a nearly ideal capacitor (100 nF to 10 μF) that builds up the electrical charge following the raising slope of the incoming sigma/delta audio signal. The tank capacitor 543 will discharge slightly as its capacitance (charge capacity) may be chosen to be at least approximately ten (10) times or more than 10 times larger than the capacitance of the piezoelectric actuator 552 ($C_{Piezo}$). The loss of voltage/charge over $C_{tank}$ may be compensated in this example by closing a switch ($SW_{source}$) 1072 connected to the implanted power supply (i.e., power management module 540).

In the embodiment of FIG. 10A, it is assumed that a 1 kHz sigma-delta audio signal (as shown in FIG. 10B) is received. The incoming sigma-delta audio signal will proportionally close SW1 ('0' sigma-delta pulse) at the sigma-delta bitrate.

In other words, a number of '0' sigma-delta pulses turn SW1 'ON' for most of the time period and the piezoelectric element will be charged.

However, the sigma-delta converter 544 will turn SW2 'ON' at times during discharging, as shown in FIG. 10C. More specifically, as shown in FIG. 10C, a negative instantaneous current "$I_L$" will flow for a short duration which is merged by the energy stored in the inductor $L_{Recovery}$ ($E_L$) by a change in the energy stored in the inductor ($\Delta E_L$). $E_L$ is defined below as shown in Equation 3, while $\Delta E_L$ is defined below as shown in Equation 4.

$$E_L = \frac{L \cdot I_L^2}{2} \text{[Joules]} \quad \text{Equation 3}$$

where L is the inductance of the inductor 550.

$$\Delta E_L = \frac{L \cdot \Delta I_L^2}{2} \text{[Joules].} \quad \text{Equation 4}$$

The instantaneous current of $I_L$ changes rapidly (i.e., 1250 kbps) and it has high peaks, although the net charge flow will become zero ($I_L \approx 0$) at the end of the charging phase. An average net current is flowing from $C_{tank}$ to $C_{Piezo}$. In other words, the $I_L$ from $C_{tank}$ to $C_{Piezo}$ as shown on FIG. 10A is greater than the $I_L$ from $C_{Piezo}$ to ground in FIG. 10C. Thus net charge is transferred from $C_{tank}$ to $C_{Piezo}$.

The instantaneous voltage $V_C$ increases slowly over $C_{Piezo}$ as charge builds up. The energy growth inside the capacitor $\Delta E_C$ is defined below in Equation 5.

$$\Delta E_C = \frac{C \cdot \Delta V_C^2}{2}. \quad \text{Equation 5}$$

The energy stored inside the capacitor at the end of the charging phase ($E_C$), assuming the maximum audio output signal for the half H-bridge, is defined below in Equation 6.

$$E_C = \frac{C \cdot (V_{DD}/2)^2}{2} \quad \text{Equation 6}$$

The presence of the low-loss switches SW1 and SW2 and the energy recovery inductor 550 will enable to recover this energy during a discharge phase as described further below.

Figure 11A:
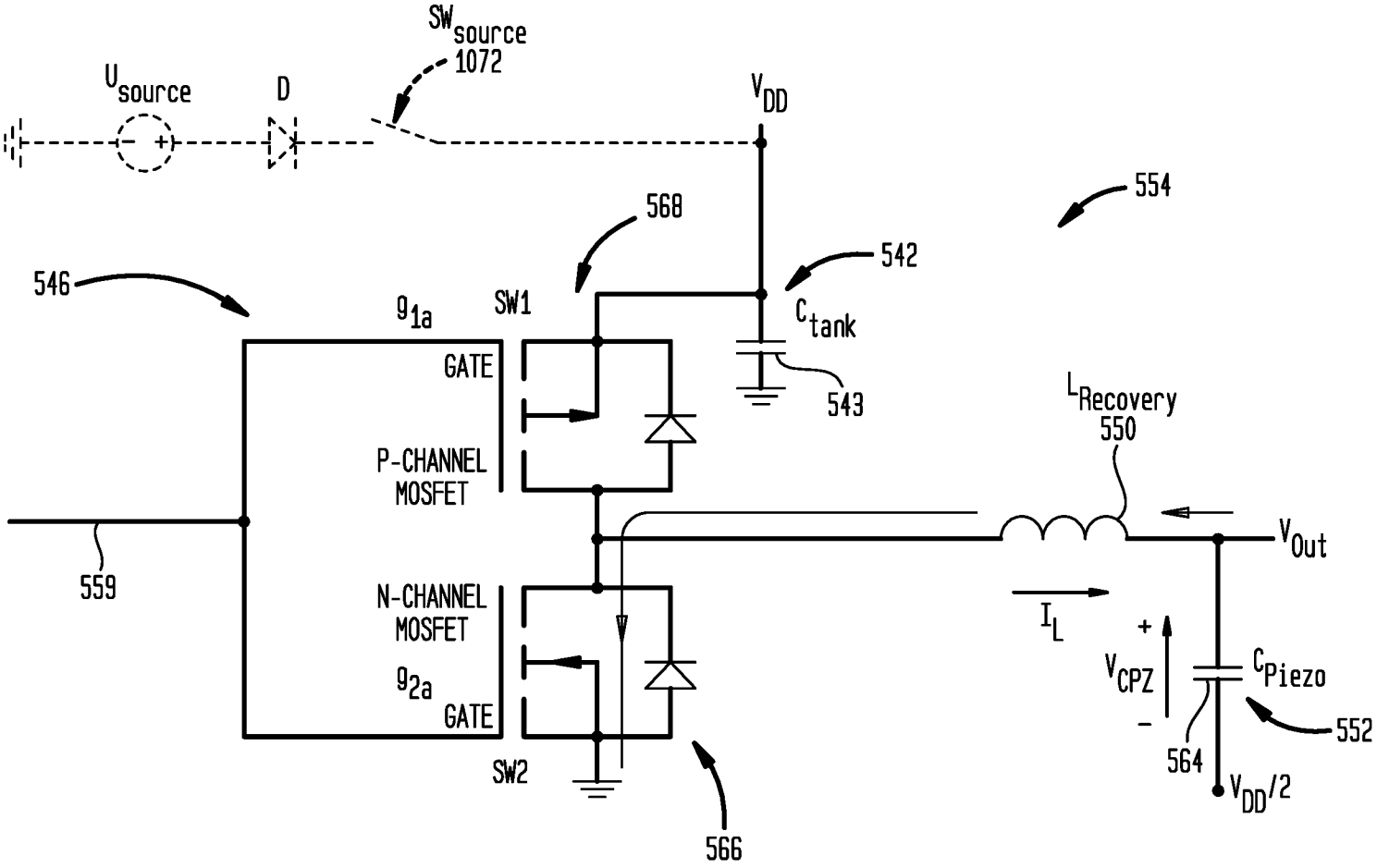
FIG. 11A is a schematic diagram illustrating current flow through a half H-bridge audio driver during a first part of a discharging phase of a piezoelectric actuator in accordance with embodiments presented herein.
Figure 11B:
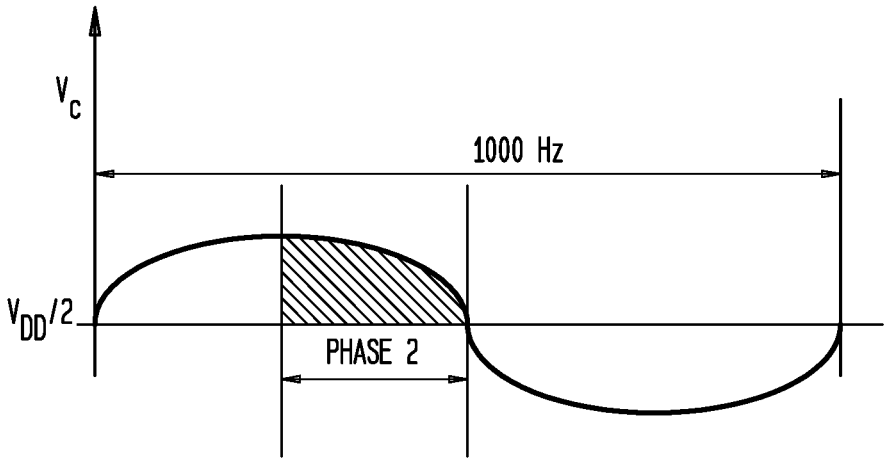
FIG. 11B illustrates a smoothened sigma-delta audio signal over the piezoelectric capacitor that is provided by the half H-bridge audio driver of FIG. 11A.
Figure 11C:
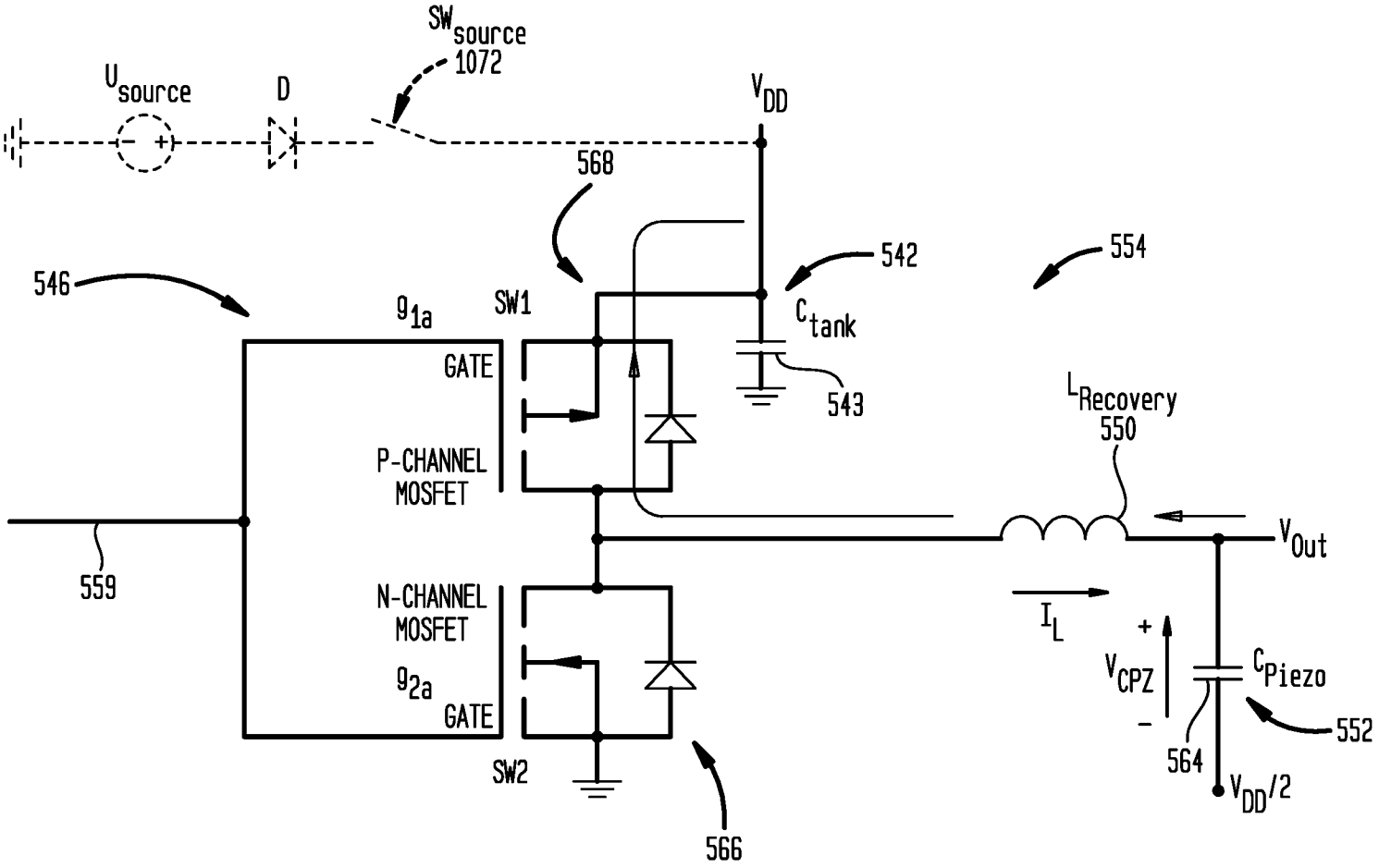
FIG. 11C is a schematic diagram illustrating current flow through the half H-bridge audio driver of FIG. 11A during a second part of the discharging phase of the piezoelectric actuator in accordance with embodiments presented herein.

More specifically, FIGS. 11A-11C illustrate a phase where the piezoelectric actuator (capacitor) 552, is discharged. This second phase is sometimes referred to herein as the "capacitor discharging phase" or simply the "discharging phase."

During the discharging phase, energy will be released from $C_{Piezo}$ as most of the time SW2 is turned 'ON.' As shown in FIG. 11A, negative instantaneous current $I_L$ will flow from $C_{Piez}$ which is merged by the energy stored in the inductor $L_{Recovery}$ (i.e., as defined above in Equation 3) by a change of change in the energy stored in the inductor (i.e., as defined above in Equation 4).

In the embodiment of FIG. 11A, it is assumed that a 1 kHz sigma-delta audio signal (as shown in FIG. 11B) is received. The incoming sigma-delta audio signal will proportionally close SW2 (1' sigma-delta pulse) at the sigma-delta bitrate. In other words, a number of '1' sigma-delta pulses turn SW2 'ON' for most of the time period and the piezoelectric element will be discharged.

However, as shown in FIG. 11C, the sigma-delta converter 544 will turn SW1 'ON' at times during the discharging phase. During the time while SW1 (S1) is 'ON,' $C_{tank}$ is being recharged as the energy recovery inductor 550 boosts the voltage above the voltage of $C_{tank}$.

Figure 12A:
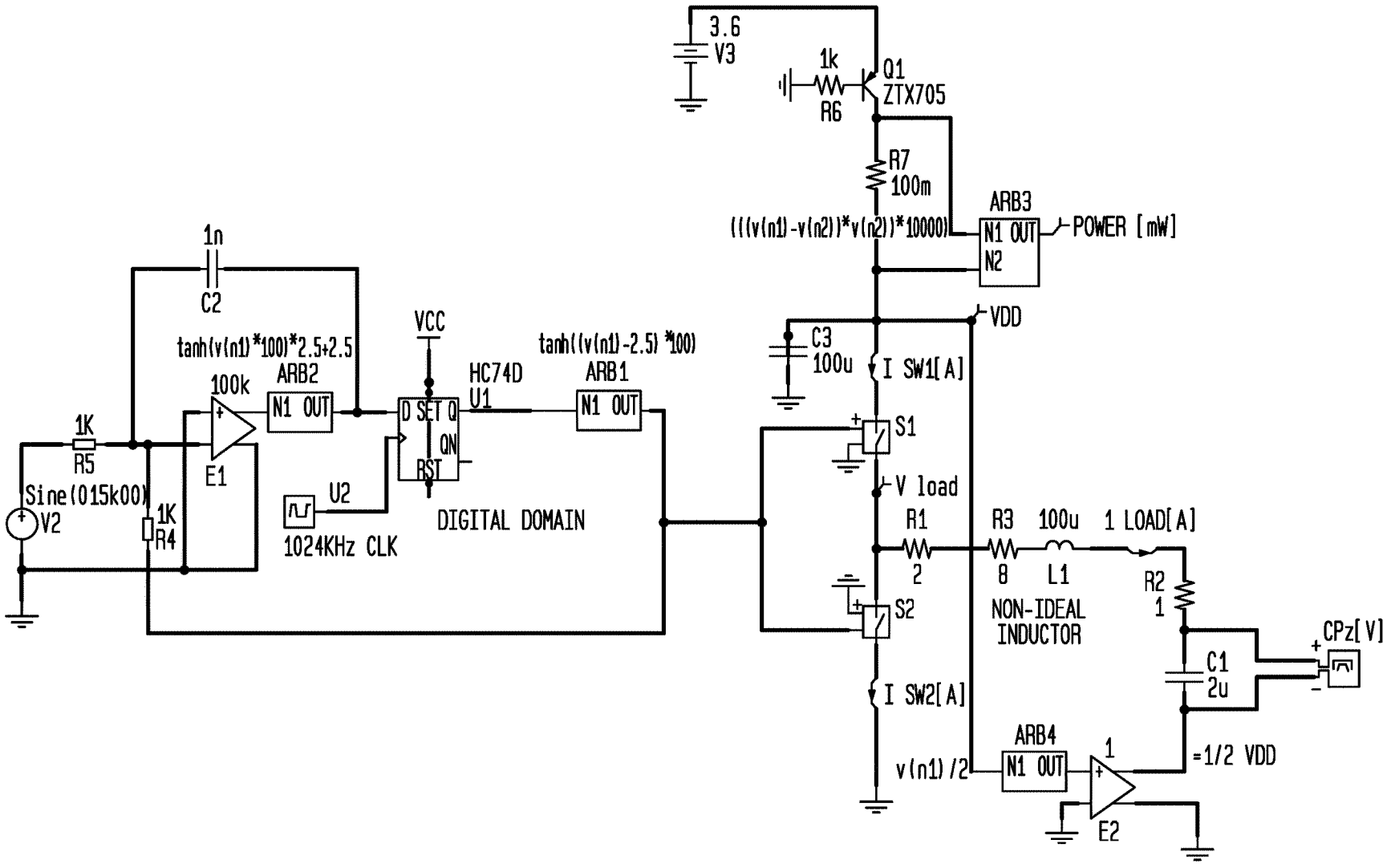
FIG. 12A is a schematic diagram of a simulated arrangement comprising an energy recovery circuit in accordance with embodiments presented herein.
Figure 12B:
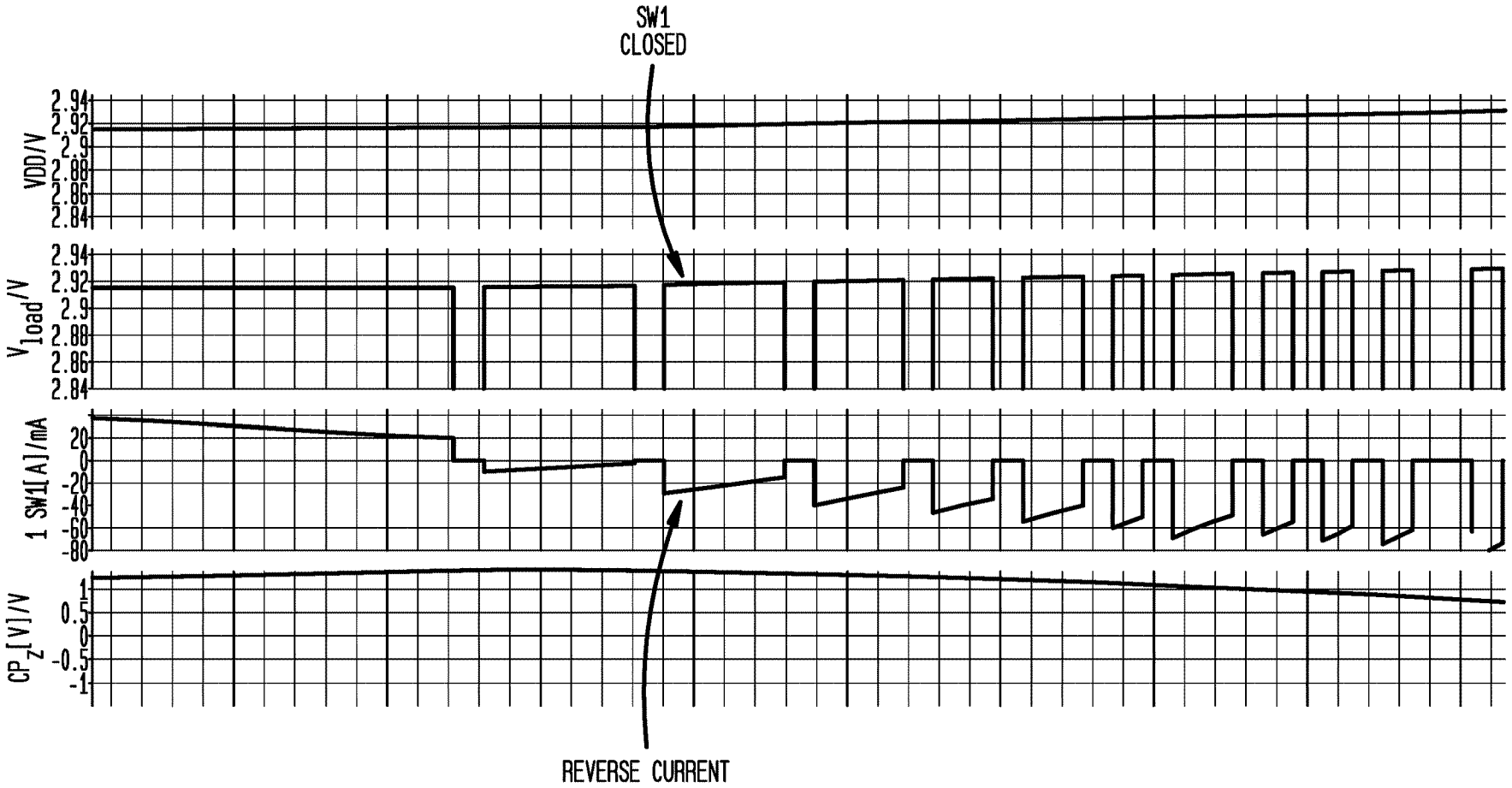
FIG. 12B is a graph illustrating a sigma-delta audio signal from a simulation result of circuit of FIG. 12A.

FIG. 12A is a schematic diagram of a simulated circuit in accordance with embodiments presented herein. FIG. 12B is a graph illustrating a simulation result of the half H-bridge Class-D amplifier circuit of FIG. 12A, with piezoelectric load and series inductor connected to the sigma-delta modulator 544 at 1024 kbps with a 5 kHz audio signal input. FIG. 12 illustrates the transition from the charging phase to the discharging phase where the voltage of the tank capacitor starts to increase due to the reverse current flowing through SW1. It should be noted that 'ON' state duration of SW1 starts to decrease as the discharging phase progresses.

Figure 12C:
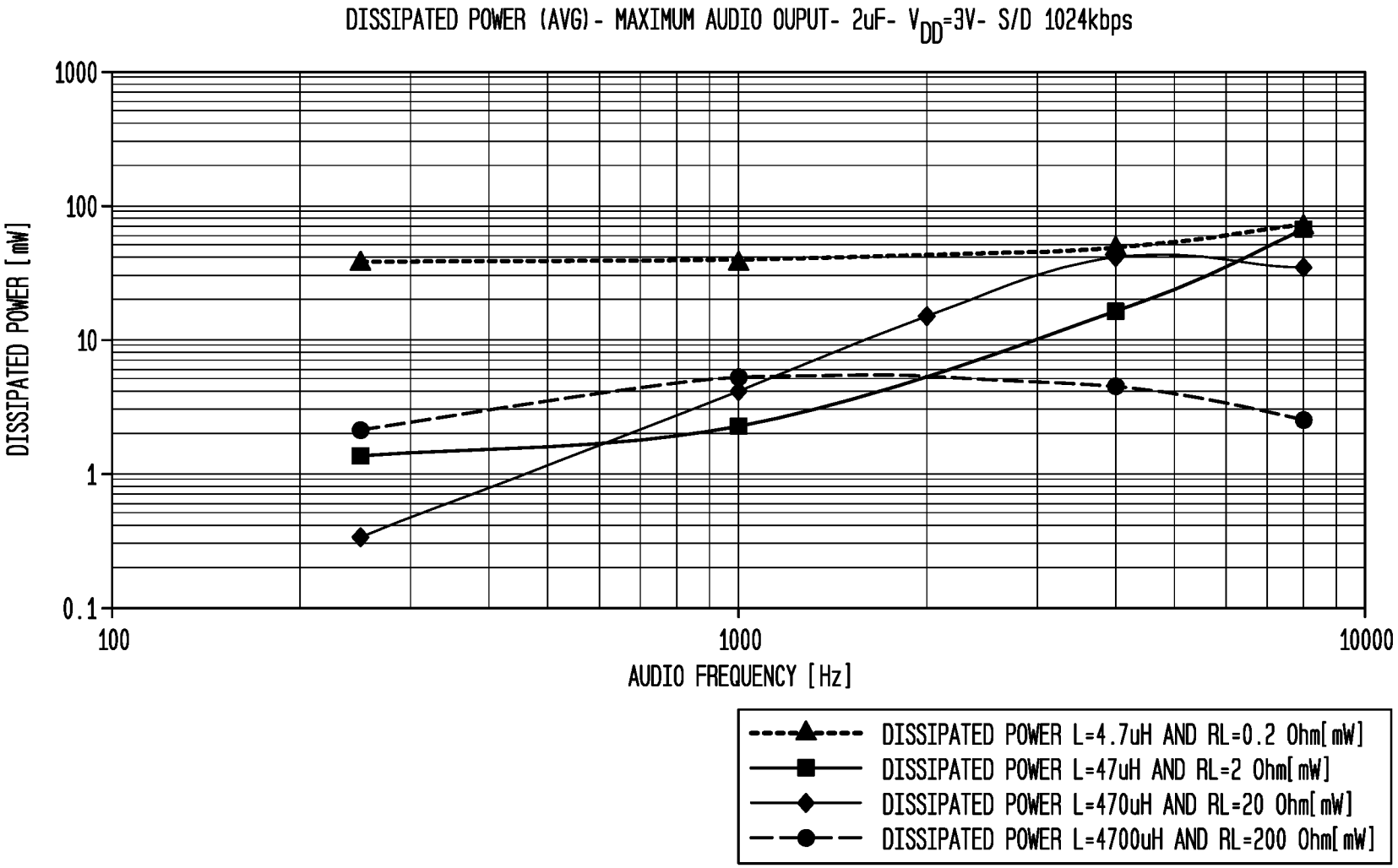
FIG. 12C is a graph illustrating simulated dissipated power for various inductor values for the circuit of FIG. 12A.

FIG. 12C is a simulated dissipated power for various inductance (L) and resistance ($R_L$) values (constant $L/R_L$ loads) for the half H-bridge Class-D amplifier circuit of FIG. 12A. The illustration of FIG. 12C represents a scenario with a Half H-Bridge audio driver, maximum audio over a 2uF piezoelectric actuator, a sigma-delta rate at 1024 kbps, and $V_{DD}$ 3V.

In summary, the energy recovery techniques utilize an inductor 550 in series between the audio driver 564 and the piezoelectric actuator 552. The inductor 550 provides a voltage boost such that, during a discharging phase, charge will flow from the piezoelectric actuator 552 to the energy recovery tank circuit 542. (i.e., $C_{tank}$ is being recharged as the energy recovery inductor 550 boosts the voltage above the voltage of $C_{tank}$). The presence of the inductor 550 and the tank circuit 542 enable charge to be recovered from piezoelectric actuator 552 during a discharge phase of the actuator (instead of dissipated as in conventional arrangements) and enable charge to be added to the piezoelectric actuator 552 from the tank circuit during the charging phase of the actuator.

The above described primarily describes the use of one inductor connected in series between the audio driver 546 and the piezoelectric actuator 552. It is to be appreciated that other arrangements are within the scope of embodiment of the present invention. For example, in one alternative arrangement first and second energy recovery inductors may be disposed on opposing sides of the piezoelectric actuator 552. That is, in such arrangements the first and second energy recovery inductors connect opposing sides of the piezoelectric actuator 552 to the audio driver 546 and both inductors assist in the energy recovery as described above.

In another example, two piezoelectric actuators may be utilized. In these examples, the capacitive piezoelectric elements (one for each actuator) are placed in parallel and the energy recovery inductor(s) are common and placed in series to both of the actuators. Alternatively, each of the piezoelectric actuators may be connected to different energy recovery circuits.

The two power-conservation techniques presented herein (i.e., the energy recovery techniques that recover charge from the piezoelectric actuator 552 and the sigma-delta quantization threshold scaling techniques that limit the number of generated sigma-delta pulses when low audio is received) enable an active bone conduction device to utilize significantly less power than conventional active bone conduction devices. In particular, use of the energy recovery techniques described above may reduce the power required by an implantable component of an active bone conduction by a factor of 10, while use of the sigma-delta quantization threshold scaling techniques may reduce the power required by an implantable component of an active bone conduction by a factor of 4. Combined, this may result in a 40-50% power savings, when compared to conventional devices.

In certain embodiments the implantable component of an active bone conduction device in accordance with embodiments of the present invention may utilize less than 2 mW. Such an ultra-low power device may facilitate the use of a single Zn-air battery as the power supply for the device.

The invention described and claimed herein is not to be limited in scope by the specific preferred embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A medical device, comprising:

one or more sensing elements configured to sense sensed signals;

a signal driver configured to generate transducer drive signals based on the sensed signals;

a transducer configured to be subcutaneously implanted within a recipient so as to generate, based on the transducer drive signals, stimulation output forces for delivery to the recipient; and an energy recovery circuit configured to extract non-used energy from the transducer and to store the non-used energy for subsequent use by the transducer.

2. The medical device of claim 1, wherein the energy recovery circuit comprises:

at least one energy recovery inductor connected in series between the signal driver and transducer; and an energy recovery tank circuit comprising a rechargeable power supply.

3. The medical device of claim 2, wherein the rechargeable power supply is at least one of a capacitor and a rechargeable battery.

4. The medical device of claim 2, wherein the at least one energy recovery inductor comprises first and second energy recovery inductors disposed on opposing sides of the transducer.

5. The medical device of claim 2, wherein the transducer operates as a low-equivalent series resistance (ESR) capacitor having a capacitance of at least approximately 1 microfarad (ρF) and an ESR less than approximately 10 ohms.

6. The medical device of claim 5, wherein the rechargeable power supply of the energy recovery tank circuit has a charge capacity of at least 10 times higher than the charge capacity of the low-ESR capacitance of the transducer.

7. The medical device of claim 1, further comprising:

a sigma-delta converter operating in accordance with a scaled sigma-delta quantization threshold value to convert received signals representative of sound into transducer drive signals, wherein the sigma-delta converter is configured to limit a number of pulses in the transducer drive signals when a level of the received signals representative of sound is below a predetermined threshold level.

8. The medical device of claim 7, wherein the sigma-delta converter is a sixteen-bit audio converter and wherein the scaled sigma-delta quantization threshold value is configurable.

9. The medical device of claim 7, further comprising:

an implantable coil configured to receive control data from an external device, wherein the control data comprises the scaled sigma-delta quantization threshold value.

10. The medical device of claim 9, wherein the scaled sigma-delta quantization threshold value is programmable at the external device.

11. The medical device of claim 1, wherein the transducer is a piezoelectric transducer.

12. The medical device of claim 1, wherein the medical device is an active transcutaneous medical device comprising an external sound processing unit with an external sensing element.

13. A method, comprising:

obtaining one or more sensed signals;

generating, with an implantable signal driver, transducer drive signals based on the one or more sensed signals, wherein the transducer drive signals are provided to an implantable transducer configured to be subcutaneously implanted within a recipient;

generating, with the implantable transducer based on the transducer drive signals, stimulation for delivery to the recipient;

extracting, with an implantable energy recovery circuit, non-used energy from the implantable transducer following delivery of the stimulation to the recipient; and storing the non-used energy for subsequent use by the transducer.

14. The method of claim 13, further comprising:

subsequently providing the non-used energy to the transducer.

15. The method of claim 13, wherein the implantable energy recovery circuit comprises at least one energy recovery inductor connected in series between the implantable signal driver and the implantable transducer, and an energy recovery tank circuit comprising a rechargeable power supply, and wherein the method further comprises:

temporarily storing the non-used energy in the rechargeable power supply.

16. The method of claim 15, wherein the rechargeable power supply is an implantable capacitor.

17. The method of claim 15, wherein the at least one energy recovery inductor comprises first and second energy recovery inductors disposed on opposing sides of the implantable transducer.

18. The method of claim 13, wherein generating the transducer drive signals based on the one or more sensed signals comprises:

scaling signals representative of the one or more sensed signals in accordance with a scaled sigma-delta quantization threshold value.

19. The method of claim 18, further comprising:

receiving control data from an external device, wherein the control data comprises the scaled sigma-delta quantization threshold value.

20. The method of claim 13, wherein generating the transducer drive signals based on the one or more sensed signals comprises:

limiting a number of pulses in the transducer drive signals when a level of the one or more sensed signals is below a predetermined threshold level.

* * * * *